US007673864B2

(12) United States Patent
Mizuno et al.

(10) Patent No.: US 7,673,864 B2
(45) Date of Patent: Mar. 9, 2010

(54) FOLDING DEVICE AND PRINTING SYSTEM

(75) Inventors: Yasuhisa Mizuno, Otsu (JP); Hajime Kanamori, Otsu (JP); Riki Murakami, Otsu (JP)

(73) Assignee: Toray Engineering Co., Ltd., Tokyo (JP)

( * ) Notice: Subject to any disclaimer, the term of this patent is extended or adjusted under 35 U.S.C. 154(b) by 552 days.

(21) Appl. No.: 11/596,888

(22) PCT Filed: Jun. 20, 2005

(86) PCT No.: PCT/JP2005/011285

§ 371 (c)(1),
(2), (4) Date: Nov. 17, 2006

(87) PCT Pub. No.: WO2005/123556

PCT Pub. Date: Dec. 29, 2005

(65) Prior Publication Data

US 2008/0070772 A1 Mar. 20, 2008

(30) Foreign Application Priority Data

Jun. 22, 2004 (JP) ..... 2004-183843
Jun. 22, 2004 (JP) ..... 2004-183844
Jun. 22, 2004 (JP) ..... 2004-183870

(51) Int. Cl.
*B41L 1/32* (2006.01)

(52) U.S. Cl. ..... 270/39.05; 270/30.01; 270/30.06; 270/30.1; 270/30.11; 270/39.01

(58) Field of Classification Search ..... 270/30.01, 270/30.06, 30.1, 30.11, 39.05, 39.01; 493/413, 493/414, 415, 448
See application file for complete search history.

(56) References Cited

U.S. PATENT DOCUMENTS 4,828,540 A * 5/1989 Fordyce ..... 493/414
5,732,315 A 3/1998 Inoue et al.
6,511,408 B2 * 1/2003 Miki et al. ..... 493/413

FOREIGN PATENT DOCUMENTS

JP 56-51757 U 5/1981

(Continued)

*Primary Examiner*—Gene Crawford
*Assistant Examiner*—Leslie A Nicholson, III
(74) *Attorney, Agent, or Firm*—Birch, Stewart, Kolasch & Birch, LLP

(57) ABSTRACT

A folding device for folding continuous paper, which is previously provided with fold lines at given intervals, along the fold lines in a zigzag pattern. The folding device comprises a feeding member of the continuous paper, a swinger fin that swings using its one end as a fulcrum like a pendulum in synchronization with the fold lines while feeding the continuous paper into its inside, and a table to be surmounted by the continuous paper that has been folded. The swinger fin includes a feed roller pair for feeding the continuous paper while sandwiching the paper therebetween, and at least a pair of guide plates facing each other with a given gap therebetween, in which the continuous paper is fed through the gap. One of the feed rollers constructing the feed roller pair and one of the guide plates, which are located on one side of the continuous paper, can be integrally opened or detached from the swinger fin.

13 Claims, 21 Drawing Sheets

FOREIGN PATENT DOCUMENTS

| | | | |
|---|---|---|---|
| JP | 60-90252 | U | 6/1985 |
| JP | 4-323165 | A | 11/1992 |
| JP | 4-323167 | A | 11/1992 |
| JP | 5-155491 | A | 6/1993 |
| JP | 5-186088 | A | 7/1993 |
| JP | 6-9127 | A | 1/1994 |
| JP | 6-247619 | A | 9/1994 |
| JP | 7-242366 | A | 9/1995 |
| JP | 8-175747 | A | 7/1996 |
| JP | 11-263480 | A | 9/1999 |
| JP | 2000-272822 | A | 10/2000 |
| JP | 2002-114439 | A | 4/2002 |

* cited by examiner

FIG. 15

| PULSE WIDTH (s) | DRIVE FREQUENCY (Hz) | DRIVE TIME (s) (PULSE WIDTH × TOP-AND-BOTTOM LENGTH PARAMETER) | | |
|---|---|---|---|---|
| PULSE WIDTH | FREQUENCY | PULSE WIDHT *14 | START | END |
| 0.00500000 | 200.00 | 0.07000000 | 0.00000000 | 0.07000000 |
| 0.00212000 | 471.70 | 0.02968000 | 0.07000000 | 0.09968000 |
| 0.00170000 | 588.24 | 0.02380000 | 0.09968000 | 0.12348000 |
| 0.00148000 | 675.68 | 0.02072000 | 0.12348000 | 0.14420000 |
| 0.00132000 | 757.58 | 0.01848000 | 0.14420000 | 0.16268000 |
| 0.00120000 | 833.33 | 0.01680000 | 0.16268000 | 0.17948000 |
| 0.00112000 | 892.86 | 0.01568000 | 0.17948000 | 0.19516000 |
| 0.00104000 | 961.54 | 0.01456000 | 0.19516000 | 0.20972000 |
| 0.00098000 | 1020.41 | 0.01372000 | 0.20972000 | 0.22344000 |
| 0.00094000 | 1063.83 | 0.01316000 | 0.22344000 | 0.23660000 |
| 0.00090000 | 1111.11 | 0.01260000 | 0.23660000 | 0.24920000 |
| 0.00086000 | 1162.79 | 0.01204000 | 0.24920000 | 0.26124000 |
| 0.00082000 | 1219.51 | 0.01148000 | 0.26124000 | 0.27272000 |
| 0.00080000 | 1250.00 | 0.01120000 | 0.27272000 | 0.28392000 |
| 0.00078000 | 1282.05 | 0.01092000 | 0.28392000 | 0.29484000 |
| 0.00074000 | 1351.35 | 0.01036000 | 0.29484000 | 0.30520000 |
| 0.00072000 | 1388.89 | 0.01008000 | 0.30520000 | 0.31528000 |
| 0.00070000 | 1428.57 | 0.00980000 | 0.31528000 | 0.32508000 |
| 0.00068000 | 1470.59 | 0.00952000 | 0.32508000 | 0.33460000 |
| 0.00066000 | 1515.15 | 0.00924000 | 0.33460000 | 0.34384000 |
| 0.00066000 | 1515.15 | 0.00924000 | 0.34384000 | 0.35308000 |
| 0.00066000 | 1515.15 | 0.00924000 | 0.35308000 | 0.36232000 |
| 0.00066000 | 1515.15 | 0.00924000 | 0.36232000 | 0.37156000 |
| 0.00066000 | 1515.15 | 0.00924000 | 0.37156000 | 0.38080000 |
| 0.00066000 | 1515.15 | 0.00924000 | 0.38080000 | 0.39004000 |
| 0.00066000 | 1515.15 | 0.00924000 | 0.39004000 | 0.39928000 |
| 0.00066000 | 1515.15 | 0.00924000 | 0.39928000 | 0.40852000 |
| 0.00066000 | 1515.15 | 0.00924000 | 0.40852000 | 0.41776000 |
| 0.00066000 | 1515.15 | 0.00924000 | 0.41776000 | 0.42700000 |
| 0.00066000 | 1515.15 | 0.00924000 | 0.42700000 | 0.43624000 |
| 0.00068000 | 1470.59 | 0.00952000 | 0.43624000 | 0.44576000 |
| 0.00070000 | 1428.57 | 0.00980000 | 0.44576000 | 0.45556000 |
| 0.00072000 | 1388.89 | 0.01008000 | 0.45556000 | 0.46564000 |
| 0.00074000 | 1351.35 | 0.01036000 | 0.46564000 | 0.47600000 |
| 0.00078000 | 1282.05 | 0.01092000 | 0.47600000 | 0.48692000 |
| 0.00080000 | 1250.00 | 0.01120000 | 0.48692000 | 0.49812000 |
| 0.00082000 | 1219.51 | 0.01148000 | 0.49812000 | 0.50960000 |
| 0.00086000 | 1162.79 | 0.01204000 | 0.50960000 | 0.52164000 |
| 0.00090000 | 1111.11 | 0.01260000 | 0.52164000 | 0.53424000 |
| 0.00094000 | 1063.83 | 0.01316000 | 0.53424000 | 0.54740000 |
| 0.00098000 | 1020.41 | 0.01372000 | 0.54740000 | 0.56112000 |
| 0.00104000 | 961.54 | 0.01456000 | 0.56112000 | 0.57568000 |
| 0.00112000 | 892.86 | 0.01568000 | 0.57568000 | 0.59136000 |
| 0.00120000 | 833.33 | 0.01680000 | 0.59136000 | 0.60816000 |
| 0.00132000 | 757.58 | 0.01848000 | 0.60816000 | 0.62664000 |
| 0.00148000 | 675.68 | 0.02072000 | 0.62664000 | 0.64736000 |
| 0.00170000 | 588.24 | 0.02380000 | 0.64736000 | 0.67116000 |
| 0.00212000 | 471.70 | 0.02968000 | 0.67116000 | 0.70084000 |
| 0.00500000 | 200.00 | 0.07000000 | 0.70084000 | 0.77084000 |

FIG. 16

| PULSE WIDTH (s) | DRIVE FREQUENCY (Hz) | DRIVE TIME (s) (PULSE WIDTH × TOP-AND-BOTTOM LENGTH PARAMETER) | | |
|---|---|---|---|---|
| PULSE WIDTH | FREQUENCY | PULSE WIDHT *28 | START | END |
| 0.00500000 | 200.00 | 0.14000000 | 0.00000000 | 0.14000000 |
| 0.00212000 | 471.70 | 0.05936000 | 0.14000000 | 0.19936000 |
| 0.00170000 | 588.24 | 0.04760000 | 0.19936000 | 0.24696000 |
| 0.00148000 | 675.68 | 0.04144000 | 0.24696000 | 0.28840000 |
| 0.00132000 | 757.58 | 0.03693000 | 0.28840000 | 0.32536000 |
| 0.00120000 | 833.33 | 0.03360000 | 0.32536000 | 0.35896000 |
| 0.00112000 | 892.86 | 0.03136000 | 0.35896000 | 0.39032000 |
| 0.00104000 | 961.54 | 0.02912000 | 0.39032000 | 0.41944000 |
| 0.00098000 | 1020.41 | 0.02744000 | 0.41944000 | 0.44688000 |
| 0.00094000 | 1063.83 | 0.02632000 | 0.44688000 | 0.47320000 |
| 0.00090000 | 1111.11 | 0.02520000 | 0.47320000 | 0.49840000 |
| 0.00086000 | 1162.79 | 0.02408000 | 0.49840000 | 0.52248000 |
| 0.00082000 | 1219.51 | 0.02296000 | 0.52248000 | 0.54544000 |
| 0.00080000 | 1250.00 | 0.02240000 | 0.54544000 | 0.56784000 |
| 0.00078000 | 1282.05 | 0.02184000 | 0.56784000 | 0.58968000 |
| 0.00074000 | 1351.35 | 0.02072000 | 0.58968000 | 0.61040000 |
| 0.00072000 | 1388.89 | 0.02016000 | 0.61040000 | 0.63056000 |
| 0.00070000 | 1428.57 | 0.01960000 | 0.63056000 | 0.65016000 |
| 0.00068000 | 1470.59 | 0.01904000 | 0.65016000 | 0.66920000 |
| 0.00066000 | 1515.15 | 0.01848000 | 0.66920000 | 0.68768000 |
| 0.00066000 | 1515.15 | 0.01848000 | 0.68768000 | 0.70616000 |
| 0.00066000 | 1515.15 | 0.01848000 | 0.70616000 | 0.72464000 |
| 0.00066000 | 1515.15 | 0.01848000 | 0.72464000 | 0.74312000 |
| 0.00066000 | 1515.15 | 0.01848000 | 0.74312000 | 0.76160000 |
| 0.00066000 | 1515.15 | 0.01848000 | 0.76160000 | 0.78008000 |
| 0.00066000 | 1515.15 | 0.01848000 | 0.78008000 | 0.79856000 |
| 0.00066000 | 1515.15 | 0.01848000 | 0.79856000 | 0.81704000 |
| 0.00066000 | 1515.15 | 0.01848000 | 0.81704000 | 0.83552000 |
| 0.00066000 | 1515.15 | 0.01848000 | 0.83552000 | 0.85400000 |
| 0.00066000 | 1515.15 | 0.01848000 | 0.85400000 | 0.87248000 |
| 0.00068000 | 1470.59 | 0.01904000 | 0.87248000 | 0.89152000 |
| 0.00070000 | 1428.57 | 0.01960000 | 0.89152000 | 0.91112000 |
| 0.00072000 | 1388.89 | 0.02016000 | 0.91112000 | 0.93128000 |
| 0.00074000 | 1351.35 | 0.02072000 | 0.93128000 | 0.95200000 |
| 0.00078000 | 1282.05 | 0.02184000 | 0.95200000 | 0.97384000 |
| 0.00080000 | 1250.00 | 0.02240000 | 0.97384000 | 0.99624000 |
| 0.00082000 | 1219.51 | 0.02296000 | 0.99624000 | 1.01920000 |
| 0.00086000 | 1162.79 | 0.02408000 | 1.01920000 | 1.04328000 |
| 0.00090000 | 1111.11 | 0.02520000 | 1.04328000 | 1.06848000 |
| 0.00094000 | 1063.83 | 0.02632000 | 1.06848000 | 1.09480000 |
| 0.00098000 | 1020.41 | 0.02744000 | 1.09480000 | 1.12224000 |
| 0.00104000 | 961.54 | 0.02912000 | 1.12224000 | 1.15136000 |
| 0.00112000 | 892.86 | 0.03136000 | 1.15136000 | 1.18272000 |
| 0.00120000 | 833.33 | 0.03360000 | 1.18272000 | 1.21632000 |
| 0.00132000 | 757.58 | 0.03696000 | 1.21632000 | 1.25328000 |
| 0.00148000 | 675.68 | 0.04144000 | 1.25328000 | 1.29472000 |
| 0.00170000 | 588.24 | 0.04760000 | 1.29472000 | 1.34232000 |
| 0.00212000 | 471.70 | 0.05936000 | 1.34232000 | 1.40168000 |
| 0.00500000 | 200.00 | 0.14000000 | 1.40168000 | 1.54168000 |

FIG. 17

| PULSE WIDTH (s) | DRIVE FREQUENCY (Hz) | DRIVE TIME (s) (PULSE WIDTH × TOP-AND-BOTTOM LENGTH PARAMETER) | | |
|---|---|---|---|---|
| PULSE WIDTH | FREQUENCY | PULSE WIDHT *14 | START | END |
| 0.00375000 | 266.67 | 0.05250000 | 0.00000000 | 0.05250000 |
| 0.00159000 | 628.93 | 0.02226000 | 0.05250000 | 0.07476000 |
| 0.00127500 | 784.31 | 0.01785000 | 0.07476000 | 0.09261000 |
| 0.00111000 | 900.90 | 0.01554000 | 0.09261000 | 0.10815000 |
| 0.00099000 | 1010.10 | 0.01386000 | 0.10815000 | 0.12201000 |
| 0.00090000 | 1111.11 | 0.01260000 | 0.12201000 | 0.13461000 |
| 0.00084000 | 1190.48 | 0.01176000 | 0.13461000 | 0.14637000 |
| 0.00078000 | 1282.05 | 0.01092000 | 0.14637000 | 0.15729000 |
| 0.00073500 | 1360.54 | 0.01029000 | 0.15729000 | 0.16758000 |
| 0.00070500 | 1418.44 | 0.00987000 | 0.16758000 | 0.17745000 |
| 0.00067500 | 1481.48 | 0.00945000 | 0.17745000 | 0.18690000 |
| 0.00064500 | 1550.39 | 0.00903000 | 0.18690000 | 0.19593000 |
| 0.00061500 | 1626.02 | 0.00861000 | 0.19593000 | 0.20454000 |
| 0.00060000 | 1666.67 | 0.00840000 | 0.20454000 | 0.21294000 |
| 0.00058500 | 1709.40 | 0.00819000 | 0.21294000 | 0.22113000 |
| 0.00055500 | 1801.80 | 0.00777000 | 0.22113000 | 0.22890000 |
| 0.00054000 | 1851.85 | 0.00756000 | 0.22890000 | 0.23646000 |
| 0.00052500 | 1904.76 | 0.00735000 | 0.23646000 | 0.24381000 |
| 0.00051000 | 1960.78 | 0.00714000 | 0.24381000 | 0.25095000 |
| 0.00049500 | 2020.20 | 0.00693000 | 0.25095000 | 0.25788000 |
| 0.00049500 | 2020.20 | 0.00693000 | 0.25788000 | 0.26481000 |
| 0.00049500 | 2020.20 | 0.00693000 | 0.26481000 | 0.27174000 |
| 0.00049500 | 2020.20 | 0.00693000 | 0.27174000 | 0.27867000 |
| 0.00049500 | 2020.20 | 0.00693000 | 0.27867000 | 0.28560000 |
| 0.00049500 | 2020.20 | 0.00693000 | 0.28560000 | 0.29253000 |
| 0.00049500 | 2020.20 | 0.00693000 | 0.29253000 | 0.29946000 |
| 0.00049500 | 2020.20 | 0.00693000 | 0.29946000 | 0.30639000 |
| 0.00049500 | 2020.20 | 0.00693000 | 0.30639000 | 0.31332000 |
| 0.00049500 | 2020.20 | 0.00693000 | 0.31332000 | 0.32025000 |
| 0.00049500 | 2020.20 | 0.00693000 | 0.32025000 | 0.32718000 |
| 0.00051000 | 1960.78 | 0.00714000 | 0.32718000 | 0.33432000 |
| 0.00052500 | 1904.76 | 0.00735000 | 0.33432000 | 0.34167000 |
| 0.00054000 | 1851.85 | 0.00756000 | 0.34167000 | 0.34923000 |
| 0.00055500 | 1801.80 | 0.00777000 | 0.34923000 | 0.35700000 |
| 0.00058500 | 1709.40 | 0.00819000 | 0.35700000 | 0.36519000 |
| 0.00060000 | 1666.67 | 0.00840000 | 0.36519000 | 0.37359000 |
| 0.00061500 | 1626.02 | 0.00861000 | 0.37359000 | 0.38220000 |
| 0.00064500 | 1550.39 | 0.00903000 | 0.38220000 | 0.39123000 |
| 0.00067500 | 1481.48 | 0.00945000 | 0.39123000 | 0.40068000 |
| 0.00070500 | 1418.44 | 0.00987000 | 0.40068000 | 0.41055000 |
| 0.00073500 | 1360.54 | 0.01029000 | 0.41055000 | 0.42084000 |
| 0.00078000 | 1282.05 | 0.01092000 | 0.42084000 | 0.43176000 |
| 0.00084000 | 1190.48 | 0.01176000 | 0.43176000 | 0.44352000 |
| 0.00090000 | 1111.11 | 0.01260000 | 0.44352000 | 0.45612000 |
| 0.00099000 | 1010.10 | 0.01386000 | 0.45612000 | 0.46998000 |
| 0.00111000 | 900.90 | 0.01554000 | 0.46998000 | 0.48552000 |
| 0.00127500 | 784.31 | 0.01785000 | 0.48552000 | 0.50337000 |
| 0.00159000 | 628.93 | 0.02226000 | 0.50337000 | 0.52563000 |
| 0.00375000 | 266.67 | 0.05250000 | 0.52563000 | 0.57813000 |

FOLDING DEVICE AND PRINTING SYSTEM

TECHNICAL FIELD

The present invention relates to a folding device for folding continuous paper along fold lines of the paper in a zigzag pattern.

BACKGROUND ART

Commonly in a printing device, such as a printer and a printing machine, which prints on continuous paper previously provided with fold lines at given intervals as viewed in a paper-feeding direction, a folding device is used to refold the printed continuous paper. In this specification, each of the given intervals is called a top-and-bottom length.

Especially in case that the printing device is an electrophotographic printer, the paper is often heated and pressed in a fixing process. The heating and the pressing make the continuous paper expand and contract. As a result, occasionally, the paper is wrinkled or tensed, and the rigidity of the paper is increased by moisture loss of the paper. Therefore, the folding of the continuous paper is sometimes difficult, so that the above-mentioned folding device is used in many cases.

In general, the folding device is made up of a feeding member for feeding continuous paper, a swinger fin that swings using its one end as a fulcrum like a pendulum in synchronization with fold lines while feeding the continuous paper into its inside, a paddle member for pressing a fold line portion of the continuous paper fed to the swinger fin, a table to be surmounted by the continuous paper that has been folded, a jam-detection sensor for monitoring the continuous paper in the process of being folded on the table and detecting a folding jam, etc. A folding jam here means a state in which the continuous paper is folded or bent in areas other than the preformed fold lines or a state in which there generates a folding defect in a part of a fold line, which is so called tenting.

The paddle member is formed of a pair of paddle units, and in many cases, the distance between the paddle units can be so changed as to correspond to the top-and-bottom length of the continuous paper.

Various data necessary for the folding operation, which includes, for example, the top-and-bottom length, printing speed and the like, is exchanged between the folding device and a printing device, such as a printer and a printing machine, by using proper communication means.

The feed rate of the continuous paper in the folding device is usually set faster than the feed rate of the continuous paper in the printing device. Accordingly, as illustrated in FIG. 5, slack is made in the continuous paper between the printing device and the folding device to monitor the size of the slack using one buffer sensor. Ordinarily, if the slack grows larger, the folding operation of the folding device is carried out. When the slack becomes smaller, the folding operation is suspended. The continuous paper is folded by carrying out the folding operation intermittently while the printing is continuously performed by the printing device.

In recent years, along with the diversification of continuous paper, there is a tendency to print on continuous paper that is thinner than ever before and special-purpose papers called label paper, tack paper, etc.

The thin continuous paper expands and contracts to a large degree due to heating and pressing in the fixing process, and is then liable to be wrinkled and tensed. For this reason, there occurs a folding jam more easily. The thin paper here is thinner than paper that weighs about 64 g/m$^2$ in basis weight.

If the printer or printing device performs the fixing process by a flash-fixing method, a folding jam occurs more often for the following reason. According to the flash-fixing method, a toner-applied area of the printed continuous paper absorbs more energy of flash lights than a non-applied area does. Accordingly, the toner-applied area and the non-applied area are different in heating degree, so that there occur imbalanced expansion and contraction, wrinkles and tension.

In a conventional folding device, when a folding jam occurs, the continuous paper or paper fragments that have caused the jam remain in the inside of the swinger fin. In order to remove them from the inside of the swinger fin, it is required to stick a hand or fingers into the narrow swinger fin. Particularly when the printing is applied onto continuous papers, such as label papers, tack papers and the like, with back sides applied with an adhesive agent and attached onto the peelable paper, if there occurs a folding jam, released labels or the like are stuck to the inside of the swinger fin. It is sometimes extremely difficult to get rid of them.

In the course of long-period use, paper powder, dust, dirt and the like are sometimes firmly stuck in the swinger fin. In order to remove and clean them, the swinger fin has needed to be disassembled.

Generally, in a pair of feed rollers for feeding a sheet-like article such as continuous paper, only one of the feed rollers is driven by a proper driving source (so-called driving roller). In this case, the other feed roller (called a driven roller) is biased by a proper biasing member such as a spring member toward the driving roller, and is pressed against the driving roller through the continuous paper or the like to rotate together.

The conventional folding device has a structure in which only one of a pair of feed rollers located in the swinger fin is driven. As stated above, however, the swinger fin makes a swinging motion using its end portion as a fulcrum. In other words, the swinger fin constantly receives acceleration and deceleration in the swinging direction. Due to the inertia created by the acceleration/deceleration, the driven roller moves away from the driving roller, and a pressing force upon the driving roller is reduced to destabilize the rotation of the driven roller. As a result, the feed of the continuous paper becomes unstable, which occasionally causes a folding jam.

Furthermore, the conventional folding device has a structure in which the pair of feed rollers is provided only to the tip end portion of the swinger fin. With this structure, however, sometimes the continuous paper cannot be stably fed within the swinger fin at a correct rate.

According to the conventional folding device, while the continuous paper is fed in the folding device, the paper gets static electricity due to friction or the like in some cases. Due to attraction of static electricity, friction resistance between the continuous paper and the inner surface of the swinger fin and the like is increased, which hampers the paper feedability. This occasionally causes a folding jam in the swinger fin or on the table to be surmounted by the continuous paper that has been folded.

It is generally ideal for a member that makes a swinging motion using its one end as a fulcrum like a swinger fin 2 to be caused to make a swinging motion of a natural rigid pendulum, or to have a sine wave-like velocity curve. However, in order to mechanically achieve the sine wave-like velocity curve, a cam and a link mechanism are required. To add to such a complicated mechanism, if swing velocity and swing width are changed according to the top-and-bottom length of the paper and the paper feed rate, a more complicated adjustment mechanism is furthermore required.

If a pulse motor is employed as a driving source of the swinger fin, it is possible to relatively easily obtain a pseudo-sine wave-like curve by properly controlling the frequency of drive pulses and the number of applied pulses. Even in this case, however, in order to change the swing velocity and the swing width so as to corresponding to the top-and-bottom length of the paper and the feed rate, it is required to maintain the frequency and the number of the applied pulses in the form of a table as many as there are combinations of top-and-bottom lengths and feed rates.

In some cases, the sine wave-like velocity curve is given up, and simple trapezoidal velocity control is carried out. In this case, a gradient of velocity in the trapezoidal velocity control at the time of acceleration/deceleration is fixed. Therefore, when the top-and-bottom length of the paper is changed, swinging time at the maximum swing velocity is also changed. This causes the disadvantage that the swinging motion of the swinger fin becomes unnatural, and that smooth paper folding is discouraged.

In the electrophotographic printer, the paper is often heated and pressed in the fixing process as described, and the heating and the pressing sometimes contracts the continuous paper. Due to the contraction, the continuous paper comes off the feeding member of the folding device, and travels obliquely or meanderingly in the folding device instead of traveling through a proper feed path. The oblique travel and the meandering travel often cause a folding jam. As illustrated in FIG. 7, however, jam detection sensors 104*a* and 104*b* of the conventional folding device monitor the continuous paper in the process of being folded on the table. Therefore, if the oblique or meandering travel occurs, the sensors often fail to immediately detect them. The folding operation and the feed of the continuous paper are not stopped until a folding jam is detected, so that there have been the problem that a large quantity of folding-jammed continuous paper is produced.

Thin continuous paper has a great degree of paper expansion/contraction caused by the heating and the pressing in the fixing process. This produces the problem that the oblique or meandering travel is liable to occur, incurring more folding-jammed continuous paper.

In case that the printer or printing device has the fixing process performed by the flash-fusing method, there also is the problem that, due to the imbalanced expansion and contraction of the paper, the oblique or meandering travel more easily occurs, incurring more folding-jammed continuous paper.

In the conventional folding device, the fold lines of the continuous paper in the process of being fed to the swinger fin and folded on the table are pressed by a vane member of the paddle member, whereby the continuous paper is laid on the table. Distance between a pair of paddle units constructing the paddle member of the folding device is often set so as to correspond to the top-and-bottom length of the continuous paper to be folded.

The conventional folding device, however, has sometimes caused a folding defect attributable to a setting mistake or setting failure in respect of the distance between the paddle units, or the like. For example, the distance between the paddle units is mistakenly set to 254 mm (10 inches), 152.4 mm (6 inches) or the like when the top-and-bottom length of the continuous paper to be folded is 203.2 mm (8 inches).

In the conventional art, the vane member rotates at constant rate all the time regardless of travel timing of the fold lines. Accordingly, sometimes not only the fold lines of the continuous paper but also areas other than the fold lines are also pressed by the vane member, and sometimes the vane member hampers the feed of the fold line portions. The vane member has occasionally caused a paper jam or folding defect.

In the conventional folding device, the setting of the continuous paper prior to the folding has been carried out manually by the operator. In order to start a smooth folding operation, the tip end of the continuous paper is preferably set to a preset optimum position, or so-called standby position. However, if the tip end of the continuous paper is set to a wrong position, it is impossible to start a smooth folding operation, which incurs a folding defect from time to time. It is preferable that not only the continuous paper but also the swinger fin, the paddle member, and the table be set to standby positions. In some cases, however, the swinger fin, the paddle member, and the table cause a folding defect by being set to different positions from their respective standby positions.

In the conventional folding device, the direction of the first fold line of the continuous paper to be folded is limited to prescribed one direction, such as a mountain fold. Therefore, if the direction of the first fold direction of the continuous paper is opposite to the prescribed direction, it is required to carry out arrangements including alignment of the folding direction of the first fold line with the prescribed direction by cutting away and discard the first page of the continuous paper.

In many cases, after all the continuous paper is folded, the continuous paper that has been folded on the table is checked. During this process, in the conventional folding device, the swinger fin is in the way for checking the folding condition of the continuous paper. Furthermore, the folded continuous paper is taken out usually after the table is lowered. If the number of laid sheets of the paper is small, the paper is often taken out from the top portion of the table without taking the trouble to lower the table. In this process, the swinger fin gets in the way and hampers the removal of the continuous paper.

According to the conventional folding device, if the continuous paper has sprocket holes in both side edges thereof, the paper sometimes comes off the feeding member of the folding device due to contraction of the continuous paper which is caused by the heating and the pressing in the fixing process of the printing device. For this reason, there occasionally generates a feeding defect of the continuous paper and a folding defect attributable to the feeding defect.

In general, a pair of pin tractors is used as a feeding member of the folding device. Distance between the pin tractors is so fixed as to correspond to the width of the continuous paper, and the pins of the pin tractors are interfitted in the sprocket holes formed in both side-edge portions of the continuous paper, to thereby feed the continuous paper. However, if the continuous paper contracts in the width direction, distance between the sprocket holes of the side-edge portions of the continuous paper becomes shorter than the distance between the pins of the pin tractors due to the contraction. As a result, the pins come off the sprocket holes to produce a feeding defect. Particularly, thin continuous paper contracts to a great degree and causes a feeding defect more often.

In case that the printing device has the fixing process performed by a flash-fusing device, sometimes more feeding defects attributable to contraction of the continuous paper are produced. According to the flash-fixing method, a toner-applied area of the continuous paper absorbs more energy of flash lights than a non-applied area does. Therefore, the toner-applied area and the non-applied area are different in degree of the heating of the continuous paper, so that there often generate fluctuations in contraction degree of the width direction as viewed in the longitudinal direction of the continuous paper.

The conventional folding device performs the folding operation through an intermittent operation as described above. In many cases, a folding defect has been caused at the start of a folding operation during the intermittent operation. The folding defect at the start of the folding operation has occurred more often in case that the continuous paper is thin or that the printing device has the fixing process performed by the flash-fusing method.

DISCLOSURE OF THE INVENTION

The present invention has been made to solve the above-mentioned problems and an object thereof is to provide a folding device that facilitates maintenance such as cleaning, enables stable feed of continuous paper, and is capable of restraining occurrence of a folding defect such as a folding jam to perform stable folding, and a printing system provided with such a folding device.

In order to achieve this object, the folding device according to an aspect of the present invention is a folding device for folding continuous paper, which is previously provided with fold lines at given intervals, along the fold lines in a zigzag pattern. The folding device comprises a feeding member of the continuous paper, a swinger fin that swings using one end thereof as a fulcrum like a pendulum in synchronization with the fold lines while feeding the continuous paper into the inside thereof, a table to be surmounted by the continuous paper that has been folded. The swinger fin has a feed roller pair for feeding the continuous paper while sandwiching the paper therebetween, and at least a pair of guide plates facing each other with a given gap therebetween, in which the continuous paper is fed through the gap. One of the feed rollers constructing the feed roller pair and one of the guide plates, which are located on one side of the continuous paper, can be integrally opened or detached from the swinger fin.

By constructing the device as described, the continuous paper previously provided with fold lines at given intervals is fed by the feeding member. The continuous paper fed into the swinger fin is properly folded by a swinging motion of the swinger fin, which is synchronized with the fold lines, to be laid on the table. When the inside of the swinger fin needs cleaning or the like, one of the feed rollers and one of the guide plates, which are located on one side of the continuous paper, are integrally opened or detached from the swinger fin.

Therefore, at the time of troubles, such as a folding defect of the continuous paper or a case in that part of the continuous paper peels off and sticks to the swinger fin, the user is not forced to do a bothersome cancel operation or the like, and can perform a cleaning operation of the inside of the swinger fin and the like without difficulty.

In the folding device, it is preferable that both the feed rollers constructing the feed roller pair be driven by a drive motor.

By constructing the device as described, the feed of the continuous paper is not destabilized, and a folding jam can be prevented.

In the folding device, it is preferable that the swinger fin has the feed roller pair in a tip end portion thereof and in an intermediate portion between the tip end portion and the fulcrum.

The above-described construction makes it possible to stably feed the continuous paper in the swinger fin at correct rate.

Furthermore in the folding device, it is preferable that the feed roller pair, the guide plates, and the table are earthed through a main body of the folding device.

The above-described construction prevents the continuous paper from being charged with electricity due to friction or the like.

In order to accomplish the aforementioned object, a folding device according to another aspect of the present invention is a folding device for folding continuous paper, which is previously provided with fold lines at given intervals, along the fold lines in a zigzag pattern. The folding device comprises a feeding member of the continuous paper, a swinger fin that swings using one end thereof as a fulcrum like a pendulum in synchronization with the fold lines while feeding the continuous paper into the inside thereof, and a table to be surmounted by the continuous paper that has been folded. The swinger fin is driven by a pulse motor and controlled in swing velocity step by step. The number of drive pulses of the pulse motor in each step is determined according to top-and-bottom length of the continuous paper. Maximum swing velocity of the swinger fin and pulse frequency in each step are determined according to feed rate of the continuous paper.

By constructing the device as described, when the continuous paper fed into the swinger fin is folded by a swinging motion of the swinger fin driven by the pulse motor to be laid on the table, the swing velocity of the swinger fin is controlled step by step. The number of drive pulses of the pulse motor in each step is determined by the top-and-bottom length of the continuous paper. The maximum swing velocity of the swinger fin and the pulse frequency in each step are determined by the feed rate of the continuous paper.

By thus controlling the swinging motion of the swinger fin, the swing velocity and swing width of the swinger fin can be easily changed according to the top-and-bottom length of the paper and the feed rate with a simple construction without using a complicated mechanism and control method, and smooth folding of the continuous paper can be realized.

In order to achieve the above-mentioned object, a folding device according to further another aspect of the present invention is a folding device for folding continuous paper, which is previously provided with fold lines at given intervals, along the fold lines in a zigzag pattern. The folding device comprises a feeding member of the continuous paper, a swinger fin that swings using one end thereof as a fulcrum like a pendulum in synchronization with the fold lines while feeding the continuous paper into the inside thereof, and a table to be surmounted by the continuous paper that has been folded, which are disposed in the order named as viewed in a feeding direction of the continuous paper. A travel sensor for detecting a traveling condition of the continuous paper is disposed between the feeding member and the swinger fin, as viewed in the feeding direction of the continuous paper.

By constructing the device as described, when the continuous paper previously provided with the fold lines at the given intervals is fed by the feeding member, and the continuous paper fed into the swinger fin is folded by a swinging motion of the swinger fin to be laid on the table, the traveling condition of the continuous paper is detected by the travel sensor in between the feeding member and the swinger fin. This makes it possible to achieve the folding device that detects oblique travel and meandering travel of the paper, which cause a folding jam, in an early stage, and does not very often produce a folding jam.

In the above-mentioned folding device, it is preferable that the continuous paper has sprocket holes in both side edges thereof, that the feeding member be a pin tractor, and that the travel sensor detect the sprocket holes.

In order to attain the above-mentioned object, a folding device according to further another aspect of the present invention is a folding device for folding continuous paper, which is previously provided with fold lines at given intervals, along the fold lines in a zigzag pattern. The folding device comprises a feeding member of the continuous paper, a swinger fin that swings using one end thereof as a fulcrum like a pendulum in synchronization with the fold lines while feeding the continuous paper into the inside thereof, a paddle member for pressing a fold line portion of the continuous paper fed to the swinger fin, a table to be surmounted by the continuous paper that has been folded, and top-and-bottom length setting means arranged for setting top-and-bottom length of the continuous paper. The paddle member includes a pair of paddle units in which distance therebetween is variable so as to correspond to the top-and-bottom length of the continuous paper and a distance-detecting member for detecting the distance between the paddle units.

By constructing the device as described, when the continuous paper previously provided with the fold lines at the given intervals is fed by the feeding member, and the continuous paper fed into the swinger fin is folded by a swinging motion of the swinger fin to be laid on the table, the fold line portion of the continuous paper is pressed by the paddle units, the distance of which is adjusted according to the top-and-bottom length of the continuous paper, which is set by the top-and-bottom length setting means, and the folding of the continuous paper is smoothly performed. In this process, since the distance between the paddle units is detected by the distance-detecting member, it is possible to detect that the distance between the paddle units is properly adjusted according to the top-and-bottom length of the continuous paper.

In the above-mentioned folding device, preferably, the folding device further comprises comparison means arranged for comparing the top-and-bottom length set by the top-and-bottom length setting means with the distance between the paddle units detected by the distance-detecting member. Moreover, option is available between a mode that displays a warning and/or inhibits the start of a folding operation when the set top-and-bottom length differs from the detected distance between the paddle units and a mode that permits the folding operation regardless of difference between the set top-and-bottom length and the detected distance between the paddle units.

By constructing the device as described, when the top-and-bottom length set by the top-and-bottom length setting means differs from the distance between the paddle units, the display of a warning and/or the inhibition of start of the folding operation can be carried out. Therefore, it is possible to prevent a folding defect caused by a setting mistake or setting failure in respect of the distance between the paddle units. It is also possible to perform the folding, giving priority to the set top-and-bottom length regardless of the detected distance between the paddle units.

In the above-mentioned folding device, preferably, the folding device further comprises communication means arranged for communicating with a printing device for printing on the continuous paper and comparison means arranged for comparing a communicated top-and-bottom length obtained from the printing device by using the communication means with the set top-and-bottom length and/or the detected distance between the paddle units. Option is available between a mode that displays a warning and/or inhibits the start of a folding operation when the communicated top-and-bottom length differs from the set top-and-bottom length and/or the detected distance between the paddle units and a mode that permits the folding operation regardless of whether or not the communicated top-and-bottom length differs from the set top-and-bottom length and/or the detected distance between the paddle units.

By constructing the device as described, a comparison is made between the communicated top-and-bottom length of the continuous paper, which is obtained by the communication means from the printing device for printing on the continuous paper, with the set top-and-bottom length and/or the detected distance between the paddle units. If they are different from each other, the display of a warning and/or the inhibition of start of the folding operation can be implemented. Therefore, it is possible to prevent a folding defect caused by a setting mistake or setting failure of the distance between the paddle units. It is also possible to carry out the folding, giving priority to the set top-and-bottom length or the detected distance between the paddle units regardless of the communicated top-and-bottom length.

In the above-mentioned folding device, preferably, each of the paddle units has a vane member arranged rotatably around a rotary shaft that is substantially parallel to the fold lines. The vane member is driven and rotated in synchronization with timing of the fold lines, to thereby press the fold lines.

By constructing the device as described, the vane member presses only the fold lines of the paper and places the continuous paper on the table. Accordingly, the folding of the continuous paper is smoothly carried out. Even if the continuous paper is stacked in many layers, the continuous paper can be maintained in a good folded appearance.

In the above-mentioned folding device, preferably, the vane member presses a fold line of the continuous paper with timing when the fold line protrudes from the tip end of the swinger fin by a certain amount.

By constructing the device as described, the vane member presses the fold line at a proper position, so that the continuous paper is smoothly folded.

In order to accomplish the aforementioned object, a folding device according to further another aspect of the present invention is a folding device for folding continuous paper, which is previously provided with fold lines at given intervals, along the fold lines in a zigzag pattern. The folding device comprises a feeding member of the continuous paper, a swinger fin that swings using one end thereof as a fulcrum like a pendulum in synchronization with the fold lines while feeding the continuous paper into the inside thereof, a paddle member for pressing a fold line portion of the continuous paper fed to the swinger fin, a table to be surmounted by the continuous paper that has been folded, and an autoloading mechanism that automatically feeds the continuous paper, an end portion of which is set in the feeding member, to a given standby position, and automatically sets the swinger fin, the paddle member, and the table into given standby positions.

By constructing the device as described, in the folding device that feeds the continuous paper previously provided with the fold lines at the given intervals using the feeding member, and folds the continuous paper that has been fed into the swinger fin by a swinging motion of the swinger fin to lay the paper on the table, when the folding of the continuous paper is started, the continuous paper that has been set in the feeding member is automatically fed to the given standby position, and the swinger fin, the paddle member, and the table are automatically set in their respective given standby positions by the autoloading mechanism.

Consequently, it is possible to prevent the problem that the continuous paper is set in a wrong position, and the folding operation cannot be satisfactorily started to cause a folding defect. Since not only the continuous paper but also the swinger fin, the paddle member, and the table are set into the proper standby positions, it is also possible to prevent the problem that they are set in wrong standby positions to cause a folding defect.

The folding device preferably further comprises a folding-direction designation member to be designated whether the direction of a first fold line of the continuous paper is a valley or mountain fold. Based on the designation given to the folding-direction designation member, the standby position of the swinger fin and/or paddle member is changed.

By constructing the device as described, according to the designation informing whether the direction of the first fold line of the continuous paper is a valley or mountain fold, the standby position of the swinger fin and/or paddle member is changed. Therefore, the position of the swinger fin and/or paddle member before the start of the folding operation is properly set, which enables efficient start of the folding operation.

In the above-described folding device, preferably, the auto-loading mechanism fixes the swinger fin in a maximum swing position in the folding operation or in a position therebeyond, and automatically feeds the continuous paper that has been set in the feeding member to the given standby position.

By constructing the device as described, the swinger fin is placed in a proper position for starting the folding operation according to the direction of the first fold line of the continuous paper, which enables the efficient start of the folding operation.

The above-described folding device preferably further comprises an auto-ejecting mechanism of the continuous paper. During an auto-ejecting operation, the swinger fin is swung and fixed to the opposite side to a retrieving direction of the continuous paper that has been folded on the table.

By constructing the device as described, when the folding of all the continuous paper is completed, the swinger fin is automatically moved and fixed to the opposite side to the retrieving direction of the paper, to thereby easily check the condition of the continuous paper that has been folded, and retrieve the folded continuous paper without difficulty.

In order to accomplish the aforementioned object, a folding device according to further another aspect of the present invention is a folding device for folding continuous paper with sprocket holes formed in both edges, the folding device having a pair of pin tractors for feeding the continuous paper. At least one of the pin tractors is disposed to be movable in a width direction of the continuous paper according to width-directional contraction of the continuous paper.

By constructing the device as described, even if the continuous paper is contracted in the width direction, at least one of the pin tractors is movable following the contraction of the continuous paper. Therefore, the continuous paper does not come off the pin tractors, which enables the smooth feed of the continuous paper.

In the above-described folding device, preferably, maximum distance between the pin tractors is changeable according to the width of the continuous paper.

Preferably, the above-described folding device further comprises a regulating member for regulating the maximum distance between the pin tractors. At least one of the pin tractors is biased by a spring member to contact with the regulating member.

In order to achieve the above-mentioned object, a folding device according to further another aspect of the present invention is a folding device for folding continuous paper previously provided with fold lines at given intervals. The folding device comprises a plurality of sensors for detecting a slack amount of the continuous paper to be folded. Folding speed of the continuous paper is variable in accordance with the slack amount.

By constructing the device as described, since the folding speed of the continuous paper is varied according to the slack amount of the continuous paper, which is detected by the sensors, it is possible to fold the continuous paper without stopping the folding device intermittently. As a consequence, it is also possible to suppress the generation of a folding defect that is liable to be caused at the start of the folding, and to realize a smooth folding operation.

In the above-described folding device, preferably, the sensors optically detect the continuous paper, and are disposed at respective heights from a floor surface.

The above-described folding device preferably further comprises a control substrate for controlling the operation of the folding device. The folding speed is varied by changing a clock frequency of the control substrate.

In any one of the above-mentioned folding devices, preferably, the continuous paper has a basic weight of 64 g/m$^2$ or less.

It is also preferable that the continuous paper be label paper or tack paper.

In order to accomplish the aforementioned object, a printing system of the present invention has an image-forming device capable of forming an image on continuous paper and the folding device as described above.

By constructing the printing system as described, it is possible to smoothly fold the continuous paper on which an image is formed.

In the above-described printing system, preferably, the image-forming device includes a heat-fixing device.

Moreover, in the above-mentioned printing system, preferably, the heat-fixing device operates by a flash-fixing method.

BRIEF DESCRIPTION OF THE DRAWINGS

FIG. 15 is a driving velocity table of the swinger fin according to one embodiment of the present invention;

FIG. 16 is a driving velocity table of the swinger fin according to one embodiment of the present invention;

FIG. 17 is a driving velocity table of the swinger fin according to one embodiment of the present invention;

BEST MODE OF CARRYING OUT THE INVENTION

An embodiment of the present invention will be described below with reference to drawings.

Figure 1:
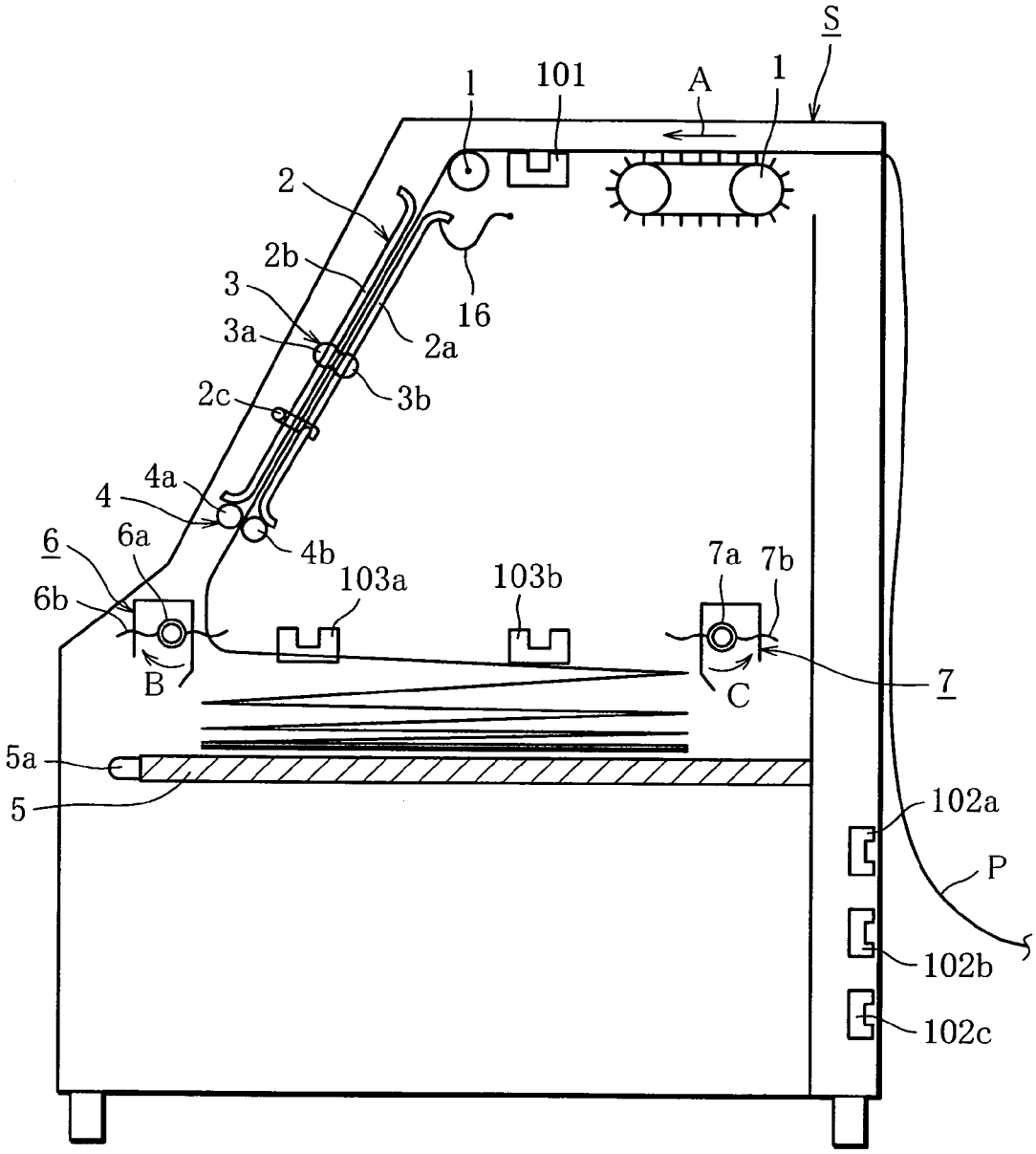
FIG. 1 is a side view of a folding device according to one embodiment of the present invention.

FIG. 1 is a sectional side view of a folding device according to one embodiment of the present invention.

In FIG. 1, reference character "P" represents continuous paper to be folded, and "S" denotes the folding device. "1" denotes a pin tractor serving as a feeding member for feeding the continuous paper P. The pin tractor feeds the continuous paper P at constant rate in a direction of arrow A in FIG. 1.

Figure 8:
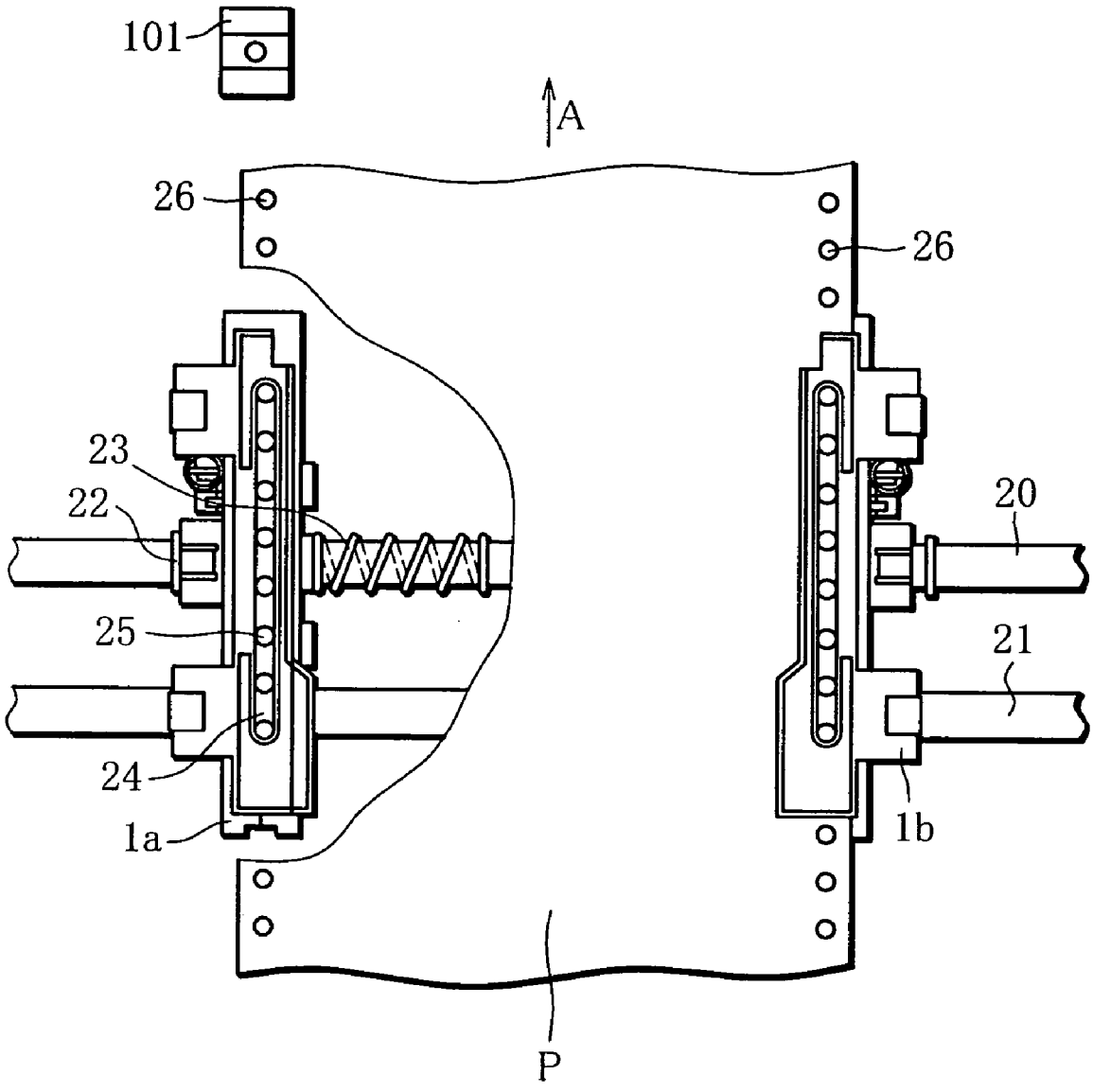
FIG. 8 is a view showing the feed of continuous paper, which is carried out by a pin tractor of the folding device according to one embodiment of the present invention.

FIG. 8 shows details of a periphery of the pin tractor. The pin tractor is made up of a pair of pin-tractor units 1*a* and 1*b* located in both width-directional edges of the paper. Pins 25 disposed on pin belts 24 of the pin tractors 1*a* and 1*b*, which is arranged in both the edges of the continuous paper P, are fit into sprocket holes 26 of both edge portions of the continuous paper P, to thereby set the continuous paper P onto the pin tractors 1*a* and 1*b*. The pin tractors 1*a* and 1*b* are pierced and supported by a common support shaft 20 and drive shaft 21. When the drive shaft 21 is driven and rotated by a driving source and a driving mechanism, not shown, the pin belts 24 rotates, and the continuous paper P is fed in the direction of arrow A in the drawing.

The pin tractor 1*a* is supported to be movable in a longitudinal direction of the support shaft 20 and the drive shaft 21 (namely, a width direction of the continuous paper P). The pin tractor 1*a* is biased toward an E-type snap ring 22 serving as a regulating member by a compression coil spring 23 serving as a spring member to contact with the E-type snap ring 22. Similarly to the pin tractor 1*a*, the pin tractor 1*b* is also supported to be movable in the longitudinal direction of support shaft 20 and the drive shaft 21. The pin tractor 1*b* can be fixed into an arbitrary position as viewed in the longitudinal direction according to the width of the continuous paper P.

If the pin tractor 1*b* is fixed into an arbitrary position as viewed in the longitudinal direction of the support shaft 20 and the drive shaft 21, maximum distance between the pin tractors 1*a* and 1*b* is regulated by the E-type snap ring 22. That is to say, the position of the pin tractor 1*b* is adjusted and fixed so that the maximum distance between the pin tractors 1*a* and 1*b* equals the width of the continuous paper P in a state of not being contracted.

Figure 9:
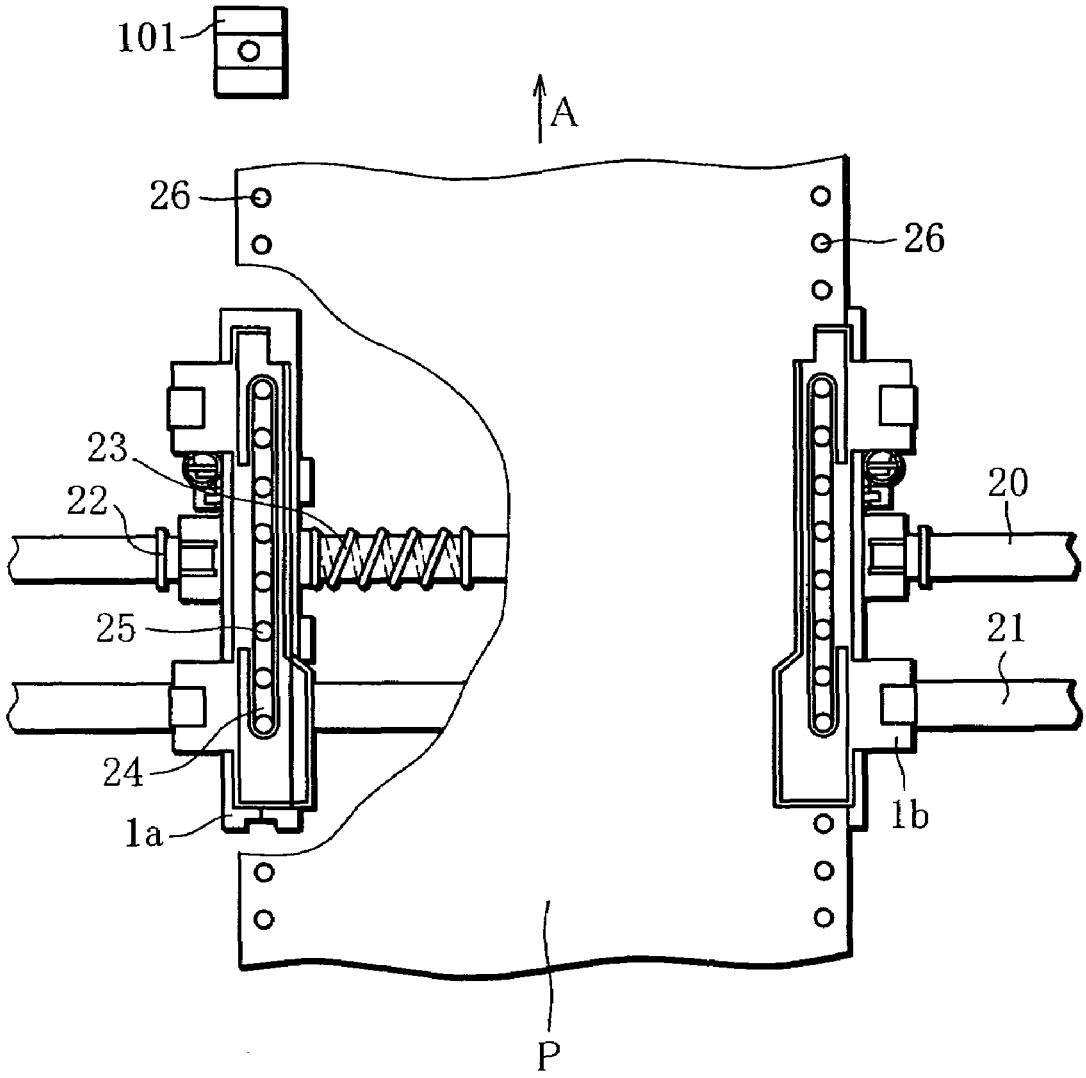
FIG. 9 is a view showing the feed of contracted paper, which is carried out by the pin tractors shown in FIG. 8.

FIG. 9 shows a state in which the continuous paper P contracts in the width direction. When the continuous paper P contracts in the width direction, since the pin tractor 1*b* is fixed to the support shaft 20, the pin tractor 1*a* moves on the support shaft 20 and the drive shaft 21 while following the contraction of the continuous paper P, resisting a spring force of the compression coil spring 23. Therefore, the fit of the pins 25 and the sprocket holes 26 is not released, so that the continuous paper P can be fed even after being contracted.

As stated above, if one of the pin-tractor units is biased by the spring member and brought into contact to the regulating member to be positioned, the distance between the pin-tractor units can be changed according to paper width. Furthermore, the pin tractor can be movable following the width-directional contraction of the continuous paper, which enables the continuous paper to be fed without coming off the pin tractors.

In FIG. 1, reference character "2" denotes a swinger fin. The swinger fin feeds the continuous paper P into the inside thereof, and is simultaneously swung by a driving mechanism, not shown, using a swing shaft 1 shown in FIG. 1 as a fulcrum. In other words, the swinger fin 2 swings to a position shown in FIG. 2A with timing when a mountain-fold line of the continuous paper P comes close to a tip end of the swinger fin 2. With timing when a valley-fold line comes close to the tip end of the swinger fin, the swinger fin swings to a position shown in FIG. 2C. The swinger fin 2 repeats such motions, thereby feeding the continuous paper P while folding the continuous paper P on the table according to the directions of original fold lines.

Reference character "3" in FIG. 1 represents an intermediate feed roller pair for feeding the continuous paper P in an intermediate portion of the swinger fin 2 and is formed of feed rollers 3*a* and 3*b*. Reference character "4" denotes a feed roller pair for feeding the continuous paper P in a tip end portion of the swinger fin 2 and is made up of feed rollers 4*a* and 4*b*. The feed rollers 3*b* and 4*b* are each coupled to a drive motor, not shown, by using a timing belt, not shown, to be driven and rotated. Feed rate at which the intermediate feed roller pair 3 feeds the continuous paper P is higher by 3 percent than feed rate of the pin tractor 1. Feed rate at which the feed roller pair 4 feeds the continuous paper P is set higher by 3 percent than the feed rate of the intermediate feed roller pair 3. Consequently, the continuous paper P can be fed in the swinger fin 2 without loosening.

Figure 11:
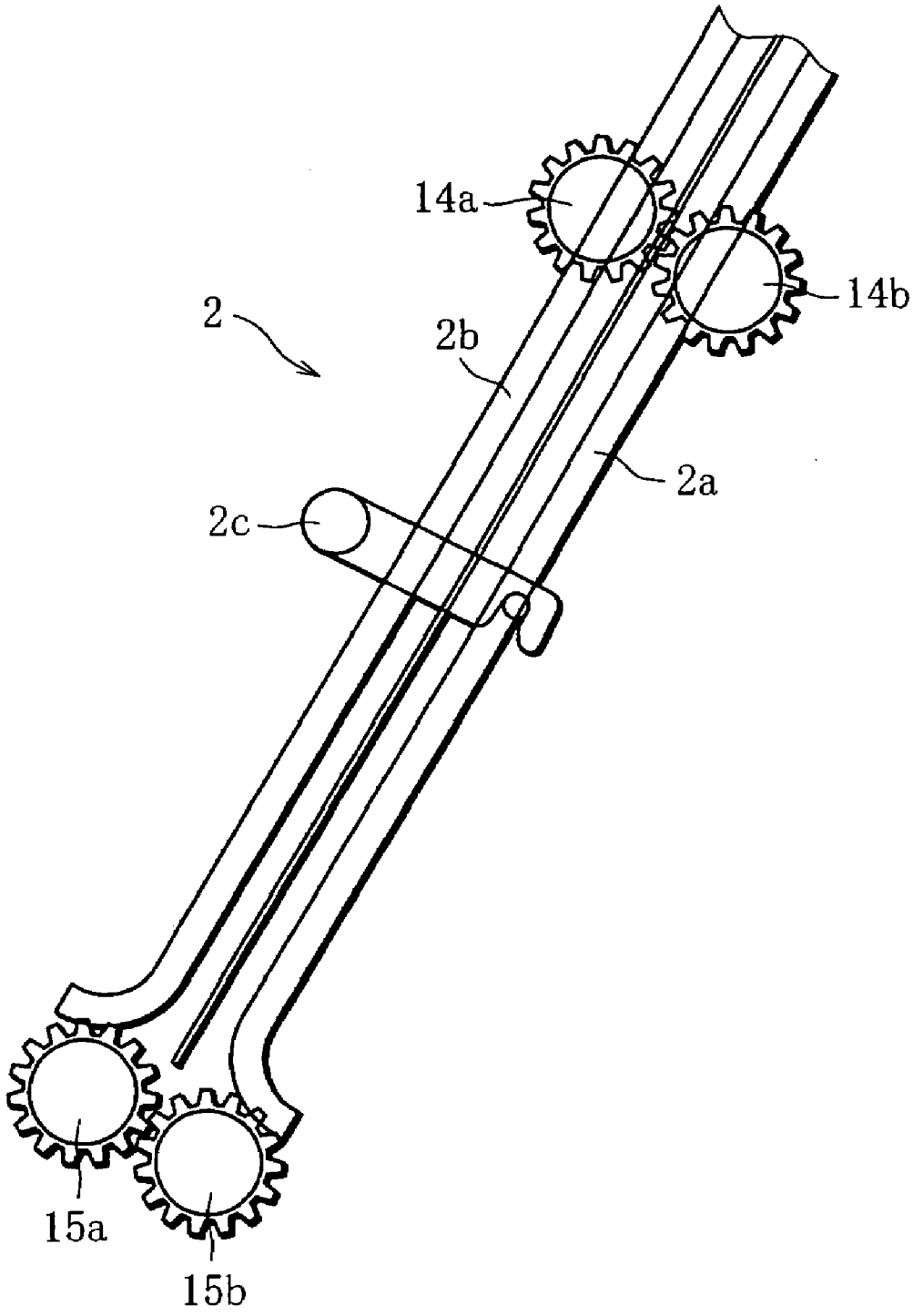
FIG. 11 is a diagram of a driving portion of a feed roller of the swinger fin according to one embodiment of the present invention.

The feed roller 3*a* is biased toward the feed roller 3*b* by a spring member, not shown, and is brought into pressing contact to the feed roller 3*b* with the continuous paper P interposed therebetween. Simultaneously, the feed roller 3*a* is applied with a driving force from the feed roller 3*b* side by gears 14*a* and 14*b* as illustrated diagrammatically in FIG. 11. For this reason, even if the feed roller 3*a* more or less moves away from the feed roller 3*b* or is reduced in a pressing-contact force against the feed roller 3*b* by being affected by acceleration during the swinging motion of the swinger fin 2, as long as the gears 14*a* and 14*b* are not disengaged from each other, the feed roller 3*a* can receive driving torque from the feed roller 3*b*. The feed roller 3*a* is not destabilized in rotation, and therefore the feed of the continuous paper does not become unstable.

In a similar fashion, the feed roller 4*a* is also biased toward the feed roller 4*b* by a spring member, not shown, and is brought into pressing contact to the feed roller 4*b* with the continuous paper P interposed therebetween. Simultaneously, the feed roller 4*a* is applied with a driving force from the feed roller 4*b* by gears 15*a* and 15*b*. Accordingly, even if the feed roller 4*a* more or less moves away from the feed roller 4*b* or is reduced in a pressing-contact force against the feed roller 4*b* by being affected by acceleration during the swinging motion of the swinger fin 2, as long as the gears 15*a* and 15*b* are not disengaged from each other, the feed roller 4*a* can receive driving torque from the feed roller 4*b*. The feed roller 4*a* is not destabilized in rotation, and therefore the feed of the continuous paper does not become unstable.

According to the present embodiment, the feed rollers 3*a* and 4*a* receive driving torque from the gears 14*a* and 14*b* and the gears 15*a* and 15*b* from the respective feed rollers 3*b* and 4*b* sides. The feed rollers 3*a* and 4*a* may receive the torque directly from a driving source such as a motor by using proper torque-transmitting means, such as a gear row, a timing belt, and a pulley.

Figure 10A:
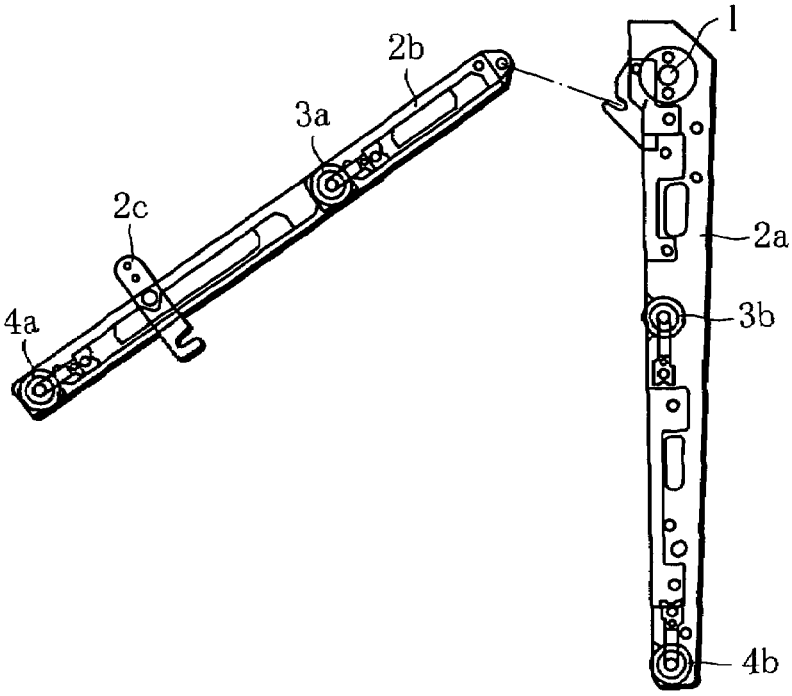
FIG. 10A is a view showing a detached state of a swinger fin according to one embodiment of the present invention.
Figure 10B:
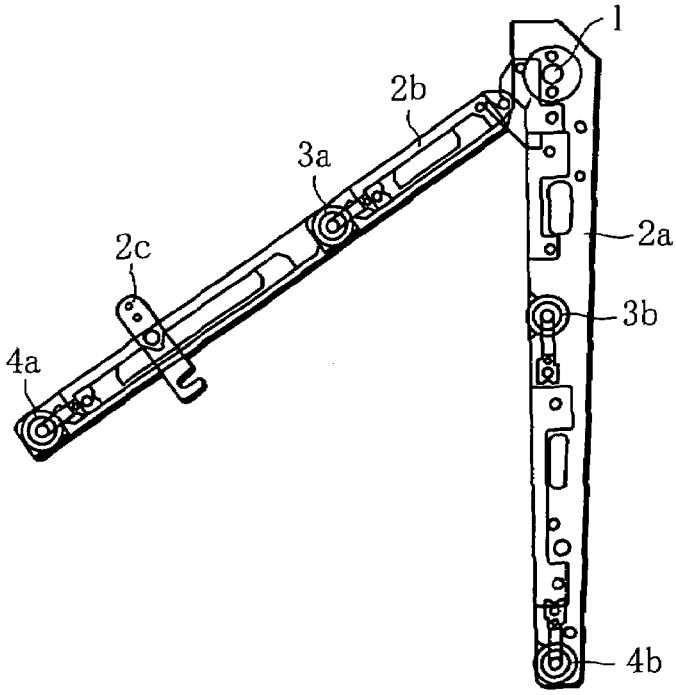
FIG. 10B is a view showing a opened state of the swinger fin according to one embodiment of the present invention.
Figure 10C:
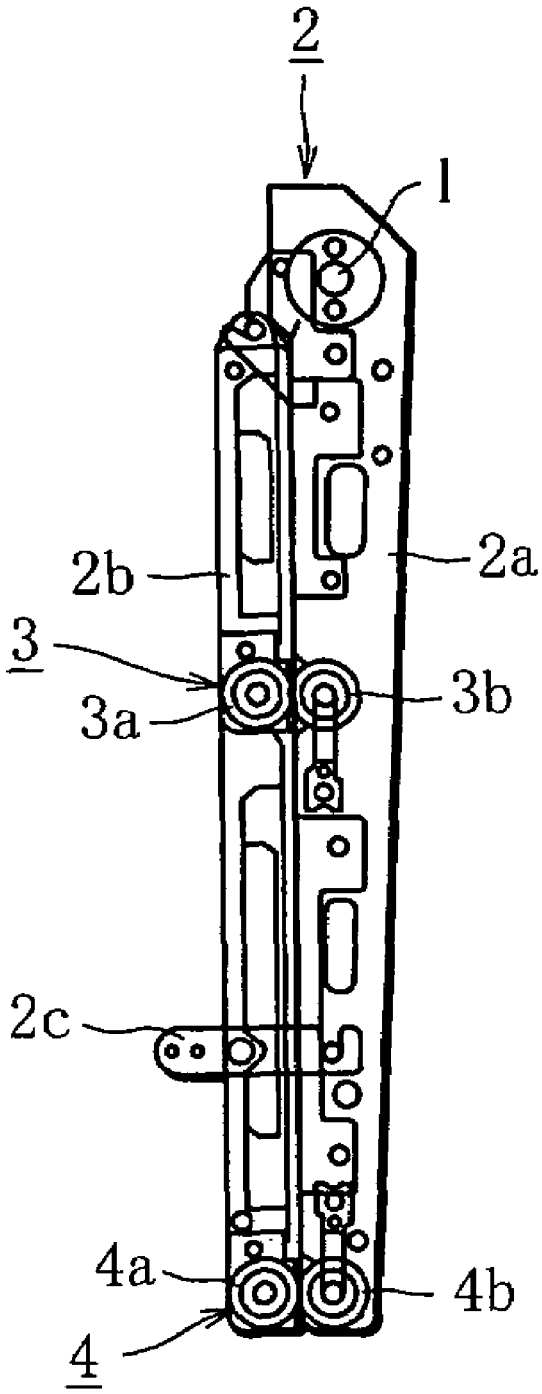
FIG. 10C is view showing a state in which the swinger fin according to one embodiment of the present invention is closed.

FIGS. 10A to 10C show opened and detached states of the swinger fin 2. The swinger fin 2 is made up roughly of a swinger fin base 2*a* and a swinger fin guide 2*b*. The swinger fin guide 2*b* is detachably fixed to the swinger fin 2*a* by using a swinger fin guide-fixing member 2*c*. The swinger fin 2 can be disassembled into two units with a feed path of the continuous paper P used as a border. That is to say, the swinger fin guide 2*b*, the feed roller 3*a*, and the feed roller 4*a* can be integrally opened and detached from the swinger fin base 2*b*. Since the swinger fin 2 can be opened and disassembled in this manner, it is possible to easily remove and clean the continuous paper and paper fragments which have been jammed, paper powder, dust, dirt, etc.

Reference character "16" in FIG. 1 denotes an earth member electrically connecting the swinger fin 2 to a main body of the folding device S and is made of a metal wire. Although the swinger fin base 2*a*, the swinger fin guide 2*b*, a bearing, not shown, supporting them, and the like, which form the swinger fin 2, are made of metal, the installment of the earth member 16 makes them more actively earth-connected to the main body of the folding device. A table 5 may be earthed by the same construction.

As to the swinging motion of the swinger fin, it is ideal to operate the swinger fin slowly in the vicinity of both end areas of the swinging motion (FIGS. 2A and 2C) and at maximum swing velocity in a middle area. The maximum swing velocity is determined according to the feed rate of the continuous paper P. In other words, it is ideal that tangential velocity of the tip end of the swinger fin at the maximum swing velocity become about the same as the feed rate of the continuous paper P. If the tangential velocity is lower than that, the continuous paper loosens in the swinger fin. If the tangential velocity is too high, the continuous paper in the process of being folded on the table 5 is pulled by the swinging motion of the swinger fin, which hampers the folding operation.

Figure 12:
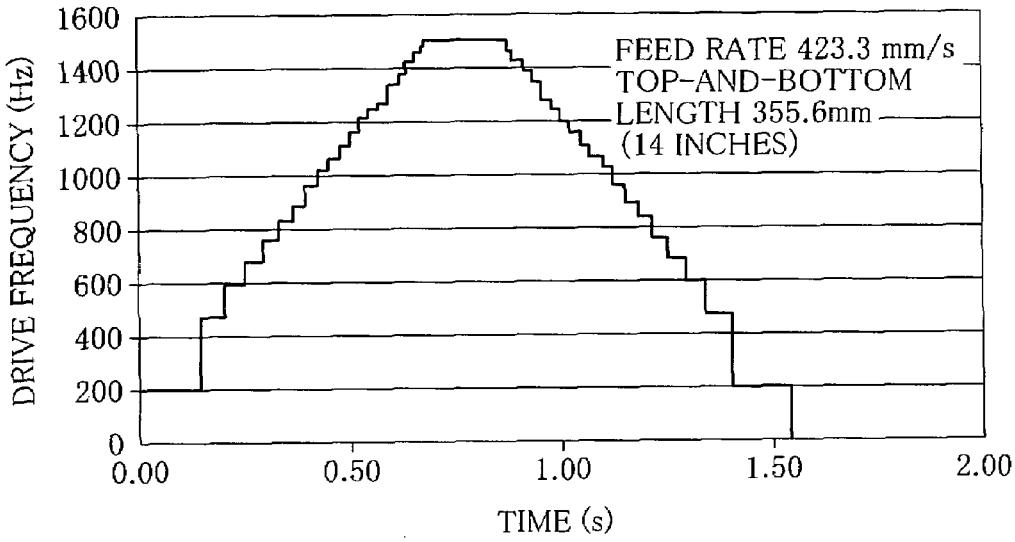
FIG. 12 is a view showing a driving velocity curve of the swinger fin according to one embodiment of the present invention.
Figure 13:
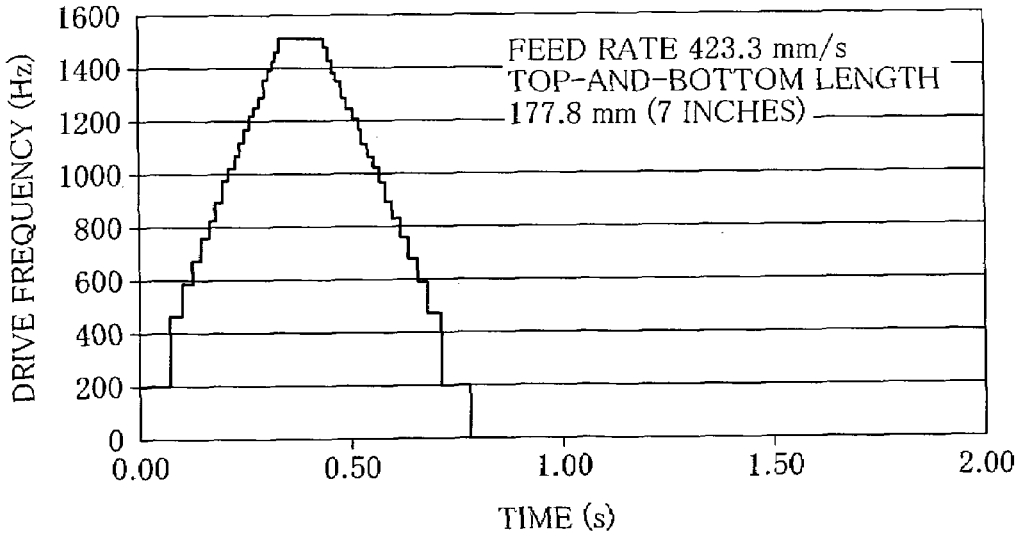
FIG. 13 is a view showing a driving velocity curve of the swinger fin according to one embodiment of the present invention.
Figure 14:
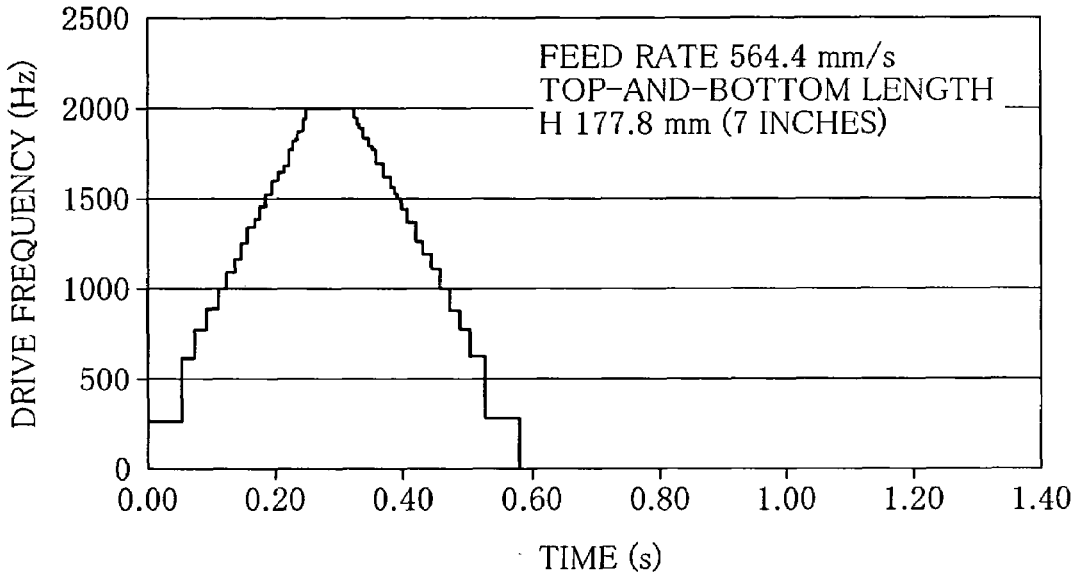
FIG. 14 is a view showing a driving velocity curve of the swinger fin according to one embodiment of the present invention.

FIGS. 12 to 14 show velocity curves of a drive pulse motor of the swinger fin 2 according to the present embodiment. In the present embodiment, while being used, the pulse motor is skillfully controlled in frequency of drive pulse thereof (drive frequency) and the number of applied pulses. By so doing, an optimum pseudo-sine wave-like curve can be obtained correspondingly to the top-and-bottom length and the feed rate with a simple mechanism and without requiring various kinds of tables.

FIG. 12 shows a case in which the feed rate is 423.3 mm/s, and the top-and-bottom length is 177.8 mm. FIG. 13 shows a case in which the feed rate is 423.3 mm/s, and the top-and-bottom length is 355.6 mm. FIG. 14 shows a case in which the feed rate is 564.4 mm/s, and the top-and-bottom length is 177.8 mm. In FIGS. 12 to 14, a horizontal axis represents time, and a vertical axis represents the pulse frequency (drive frequency) of the drive motor, that is, the swing velocity of the swinger fin 2. The swing velocity is controlled step by step as illustrated in the figures.

Referring to FIGS. 12 and 13, the paper feed rates are the same, so that the maximum swing velocities equals to each other, and the number of drive pulses in each velocity step is changed according to the top-and-bottom length of the paper. This is shown in FIGS. 15 and 16. In FIGS. 15 and 16, it is apparent that a top-and-bottom length parameter, namely the number of drive pulses to each step, is changed from 14 to 28.

Comparison between FIG. 12 and FIG. 14 (FIGS. 15 and 17) is made when the top-and-bottom lengths are identical, and the paper feed rates are different. It is clear that, in this case, since the top-and-bottom lengths are the same, the numbers of drive pulses (top-and-bottom length parameters) in all steps are identical, and the pulse frequency and the maximum swing velocity are changed according to the feed rate.

Reference character "5" in FIG. 1 represents a table to be surmounted by the folded continuous paper P. The table 5 automatically is lowered by a descending mechanism, not shown, according to amount of the continuous paper P folded on the table 5. Reference character "5*a*" denotes a handle for pulling out the table 5 in a paper-retrieving direction. The table 5 can be pulled out by means of a slide mechanism, not shown, in a direction of the handle 5*a*.

Reference characters "6" and "7" denote a pair of paddle units, which construct a paddle member. The paddle unit 6 is formed of a paddle rotary shaft 6*a* and paddle plates 6*b* serving as a vane member fixed to the paddle rotary shaft 6*a*. The paddle unit 7 is formed of a paddle rotary shaft 7*a* and paddle plates 7*b* serving as a vane member fixed to the paddle rotary shaft 7*a*.

The paddle plates 6*b* and 7*b* are made of rubber plates having proper elasticity, or the like, and are arranged around the respective paddle rotary shafts at a pitch of 180 degrees. The paddle rotary shafts 6*a* and 7*a* are so constructed to be driven and rotated by a driving mechanism, not shown, in directions of arrows B and C, respectively, in the drawing, whereby the paddle plates 6*b* and 7*b* press fold line portions of the continuous paper P every half rotation. The paddle plates 6*b* and 7*b* are driven to make half rotation in synchronization with timing of a fold line of the continuous paper P, namely a swinging motion of the swinger fin, so as to press the fold line with timing when the fold line protrudes from the tip end of the swinger fin 2 by a certain amount.

Figure 3:
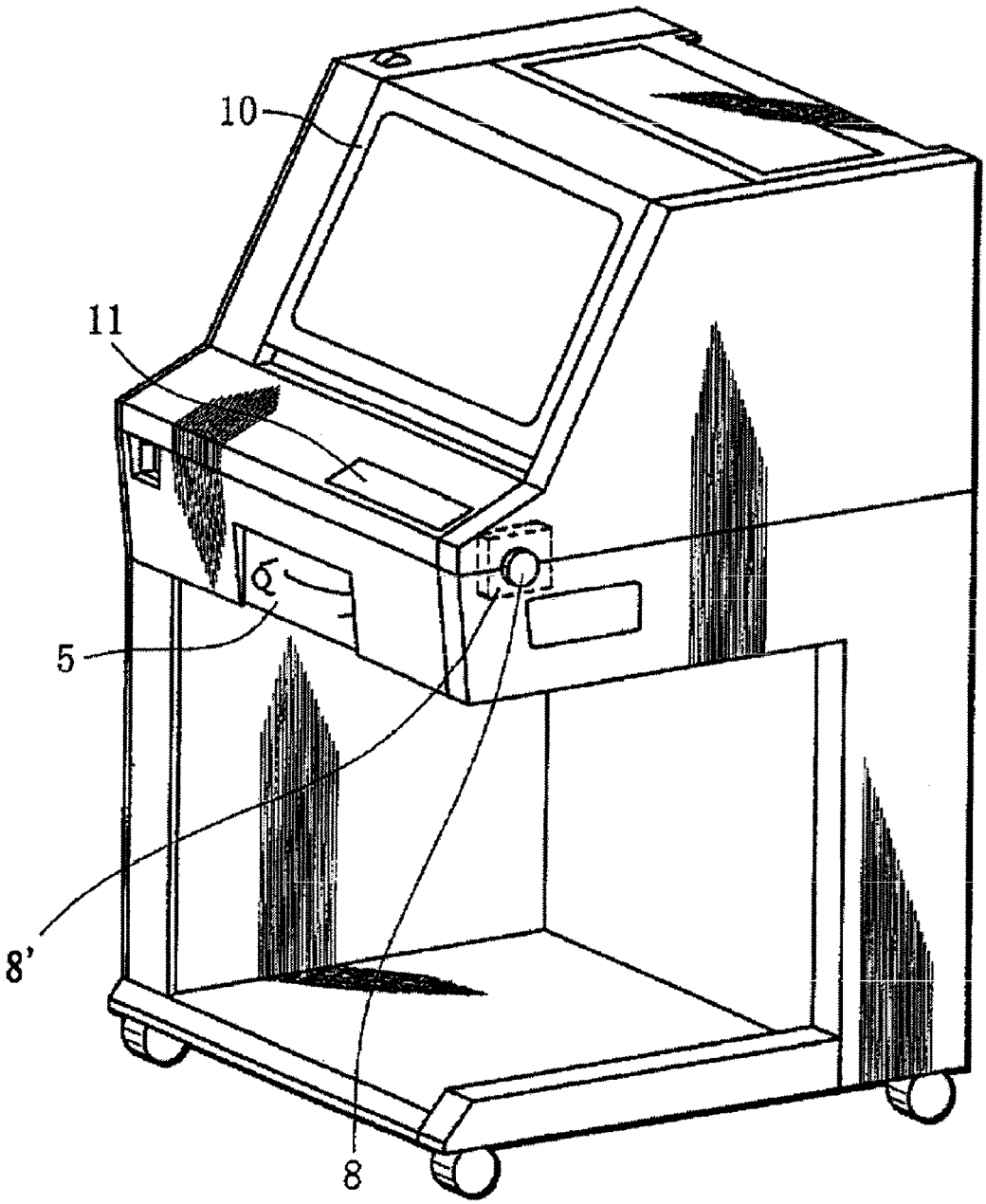
FIG. 3 is a perspective view of an appearance of the folding device according to one embodiment of the present invention.

Reference character "8" of FIG. 3 denotes a paddle unit distance changing knob for changing distance between the paddle units 6 and 7. By rotating the paddle unit distance changing knob 8, the distance between the paddle units 6 and 7 can be changed and adjusted by an interlocking mechanism, not shown, so as to correspond to the top-and-bottom length of the continuous paper to be folded. A potentiometer, 8' serving as a member for detecting the distance between the paddle units is connected coaxially with the paddle units distance changing knob 8. The distance between the paddle units 6 and 7 can be calculated from a rotation angle of the paddle unit distance changing knob, which is detected by the potentiometer. Reference character "101" in FIG. 1 denotes a jam detection sensor for detecting oblique travel and meandering travel of the continuous paper P that is fed by the pin tractors 1, and a reflected-light type optical sensor is used. Reference characters "102*a*", "102*b*", and "102*c*" denote buffer sensors for detecting slack of the continuous paper P released from a printing device such as a printer. They are reflected-light type optical sensors and are sensors that output analog voltage corresponding to distance from a sensor of an article detected. Reference characters "103*a*" and "103*b*" denote paper-surface sensors for monitoring a top surface of the continuous paper P laid on the table 5 and maintaining relative distance between the tip end of the swinger fin 2 and the top surface of the continuous paper P substantially constant. The paper-surface sensors are emitter/receiver-type optical sensors.

Figure 2A:
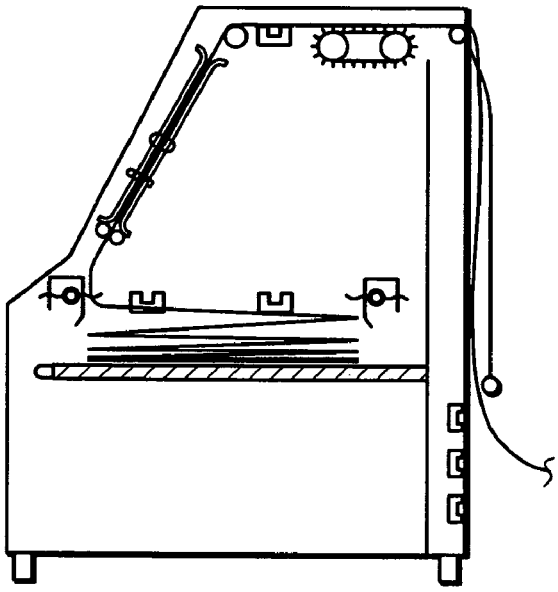
FIG. 2A is a view showing a state in which a swinger fin of the folding device according to one embodiment of the present invention is located in a maximum swing position.
Figure 2B:
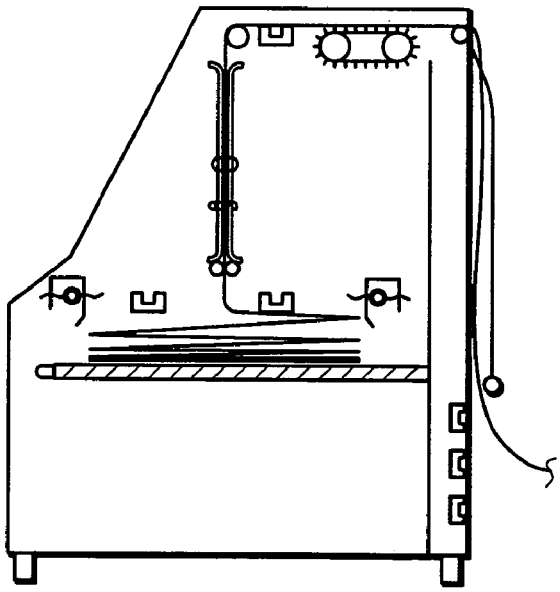
FIG. 2B is a view sowing a state in which the swinger fin of the folding device according to one embodiment of the present invention is located in a home position.
Figure 2C:
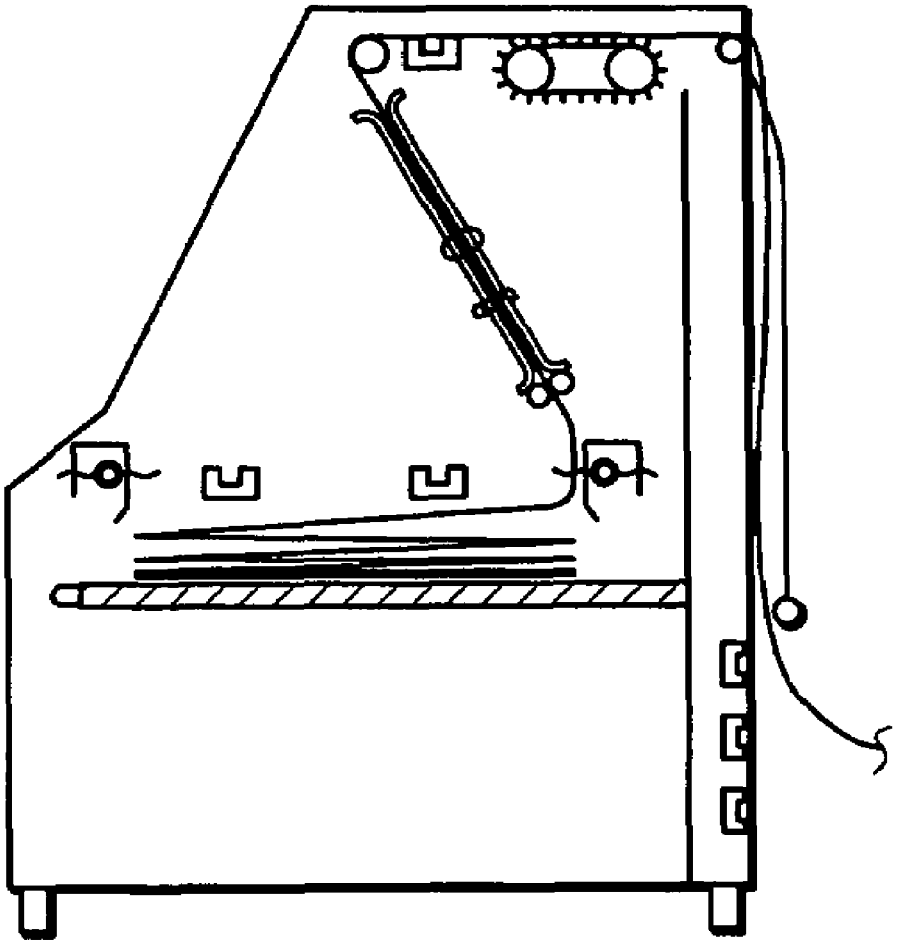
FIG. 2C is a view showing a state in which the swinger fin of the folding device according to one embodiment of the present invention is located in a maximum swing position of an opposite direction to the direction shown in FIG. 2A.

FIG. 2 show the swing of the swinger fin 2 and illustrate swinging positions of the swinger fin 2 when the continuous paper having the maximum top-and-bottom length that can be folded by a folding device S of the present embodiment is folded. FIG. 2A shows a stop position in which the swinger fin 2 swings toward the operation panel 11 to the fullest extent and then stops. FIG. 2B shows a position in which the swinger fin 2 is substantially vertical. This position is called a home position. FIG. 2C shows a stop position in which the swinger fin 2 swings in the opposite direction to the direction shown in FIG. 2A to the fullest extent and then stops.

The swinger fin 2 makes a swinging motion substantially symmetrically with the position in FIG. 2B viewed as center of symmetry. Needless to say, when the continuous paper with top-and-bottom length shorter than the maximum top-and-bottom length is folded, the swinger fin 2 makes the swinging motion at a swing angle smaller than angles shown in FIGS. 2A and 2C correspondingly to the top-and-bottom length. Rotation and driving of the paddle units are carried out at optimum values of after-mentioned rotational frequency, rotation timing, and the like, in accordance with the top-and-bottom length.

Referring to FIG. 3, reference character "10" represents a cover, and "11" denotes an operation panel for performing display of a state of the folding device S and operation thereof.

The operation of the folding device S will be described below in the order of operating procedures.

Figure 4:
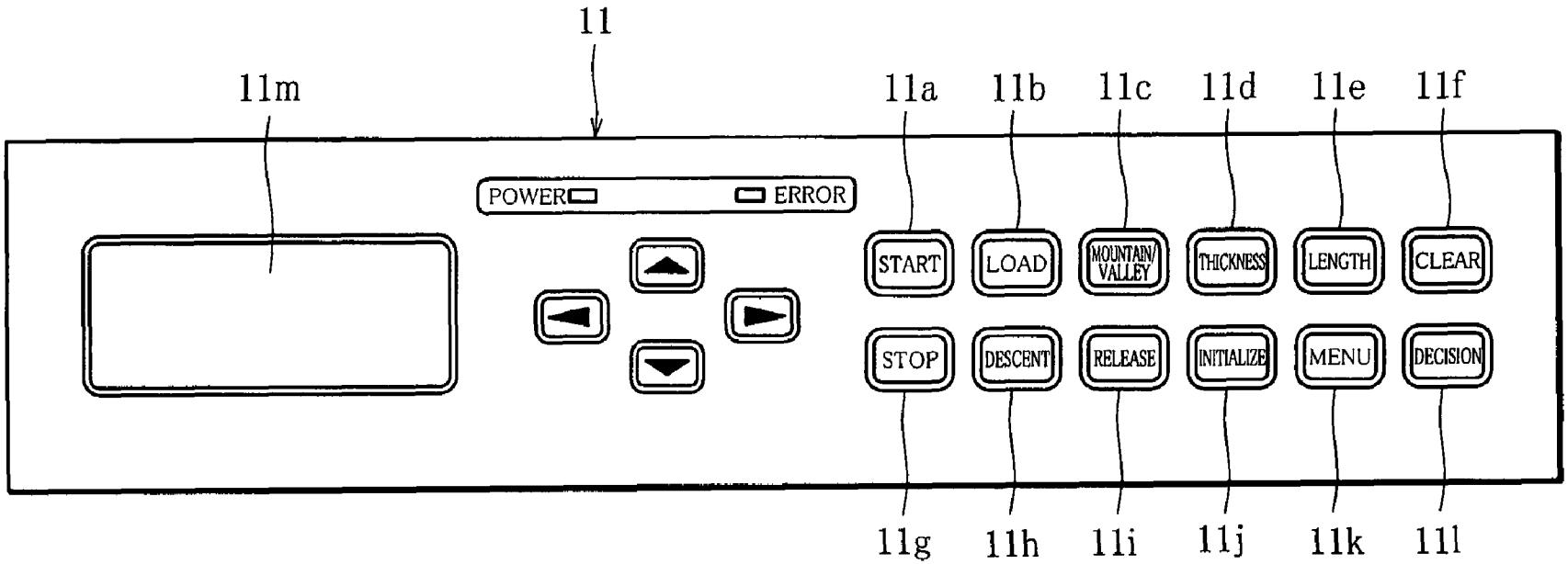
FIG. 4 is a view showing an operation panel of the folding device according to one embodiment of the present invention.

First, an autoloading operation will be explained. The end portion of the continuous paper P is set to the pin tractors 1, and in this state, an autoloading button 4*b* of the operation panel 11 illustrated in FIG. 4 is pressed down, thereby carrying out the autoloading operation.

During the autoloading operation, regardless of the top-and-bottom length of the continuous paper P to be folded, the swinger fin 2 first stops at the position shown in FIG. 2A. This position is preferable because a fold angle of the continuous paper P at the time point when the continuous paper P enters the swinger fin 2 is minimum in this position, so that the end of the continuous paper P is smoothly inserted in between the swinger fin base 2*a* and the swinger fin guide 2*b* of the swinger fin 2. If the swinger fin 2 is widely swingable toward the operation panel 11 farther than the position shown in FIG. 2A, the autoloading operation may be performed with the swinger fin 2 fixed to the position farther than the position shown in FIG. 2A.

Next, the intermediate feed roller pair 3, the feed roller pair 4, and the pin tractors 1 are driven, thereby feeding the continuous paper P until the end of the continuous paper P reaches a position most suitable for starting smooth folding, which is a so-called standby position. The standby position of the continuous paper P is a position in which the end of the continuous paper P protrudes from the swinger fin 2 by a certain distance, or 50.8 mm (2 inches) in the present embodiment. This distance may be changed according to conditions, such as kinds or thickness of the continuous paper to be folded.

Subsequently, the swinger fin 2, the table 5 and the paddle members 6 and 7 are set in standby positions.

The swinger fin 2 once swings to and stops in the home position shown in FIG. 2B. Thereafter, the swinger fin 2 swings to and stops in the position shown in FIG. 2A as a standby position if a first fold line of the continuous paper P is a valley fold, and swings to and stops in the position shown in FIG. 2C if the first fold line is a mountain fold. The standby position is previously determined to be an optimum position for each top-and-bottom length of the continuous paper P and is stored in a nonvolatile memory in the form of a table divided by top-and-bottom lengths. The optimum positions may be changed according to the kinds of paper, and a plurality of tables divided by top-and-bottom lengths may be prepared according to the kinds of paper.

Designation of a folding direction of the first fold line of the continuous paper P is carried out using a folding-direction setting button 11*c* of the operation panel 11 shown in FIG. 4. The designation of the folding direction may be performed before the end of the continuous paper P is set to the pin tractors 1.

The procedure of shifting the table 5 to the standby position will be described below. In case that at least one of the paper-surface sensors 103*a* and 103*b* is in the process of detecting the top surface of the table 5 or the top surface of the continuous paper P folded on the table 5, the descending mechanism, not shown, is activated to lower the table 5 to the position where both the paper-surface sensors do not detect the top surface of the table 5 or the top surface of the continuous paper P folded on the table 5 (standby position) and then stop the table 5.

The standby positions of the paddle members 6 and 7 are such positions that the paddle plates 6*b* and 7*b* are substantially parallelized with the table 5, and the rotary shafts 6*b* and 7*b* are driven and stopped so that the paddle plates 6*b* and 7*b* come into the standby positions. The rotary shafts 6*b* and 7*b* are driven by a pulse motor, not shown. By driving the pulse motor with a given number of pulses, the paddle members 6 and 7 are set into the prescribed standby positions.

Subsequently, the top-and-bottom length of the continuous paper P is set. Information about the top-and-bottom length of the continuous paper is classified into three kinds including a set top-and-bottom length to be inputted by the operator using a top-and-bottom length setting button 11*e* of the operation panel 11, a communicated top-and-bottom length obtained from the printing device such as a printer through communication, and a detected paddle unit distance detected by the paddle unit distance detection sensor. In the present embodiment, the operator can choose one among three modes to prioritize one of the three set values of the top-and bottom length of the continuous paper.

A first mode is a mode for prioritizing the communicated top-and-bottom length obtained from the printing device such as a printer through communication. As to the printing device such as a printer, it is usually the case that printing is performed with respect to each top-and-bottom length, and that data to be printed and operation of the printer are also controlled on the basis of the top-and-bottom length. There is an advantage that if a top-and-bottom length set value of the folding device is always set at the top-and-bottom length of the continuous paper to be printed by the printer, the operator can save the trouble of inputting the top-and-bottom length into the folding device each time.

In this mode, the input of the top-and-bottom length from the operation panel 11 of the folding device may be disregarded; or alternatively, the input itself may be counted as invalid. If the communicated top-and-bottom length and the detected paddle unit distance are different from each other, a warning may be displayed on the operation panel. It is possible not to allow the folding operation to begin unless the operator sets the distance between the paddle units to be an equal value to the communicated top-and-bottom length.

A second mode is a mode for prioritizing the set top-and-bottom length to be inputted from the operation panel 11. This mode is suitable for the following situation.

As stated above, in the printing device such as a printer, printing is carried out with respect to each top-and-bottom length. However, there is a printing form called double-page printing, which prints data corresponding to two pages in one top-and-bottom length, multi printing or the like. In such a case, if the top-and-bottom length of the continuous paper P is, for example, 244 mm (10 inches), occasionally the communicated top-and-bottom length obtained from the printer is half of that, namely 127 mm (5 inches). Therefore, the above-described first mode is not suitable.

In this mode, if the set top-and-bottom length is different from the communicated top-and-bottom length or the detected paddle unit distance, a warning may be displayed on the operation panel in the same manner to urge the operator to reconfirm the set top-and-bottom length. Alternatively, the set top-and-bottom length may be always given first priority without warning.

A third mode is a mode that places first priority on the detected paddle unit distance, that is, paddle mode. In this mode, the detected paddle unit distance is given first priority, so that as long as at least the paddle unit distance is correctly set so as to correspond to the top-and-bottom length of the continuous paper P, the folding operation can be properly performed.

These three modes can be chosen from a mode option window that is displayed on a display panel 11*m* by pressing down a menu button 11*k* of the operation panel 11. The operator can properly choose and set a mode according to a printing form that is mainly implemented or the kind of paper to be primarily used. If communication with the printing device 100 is not carried out, a choice is made between the second and third modes.

Figure 5:
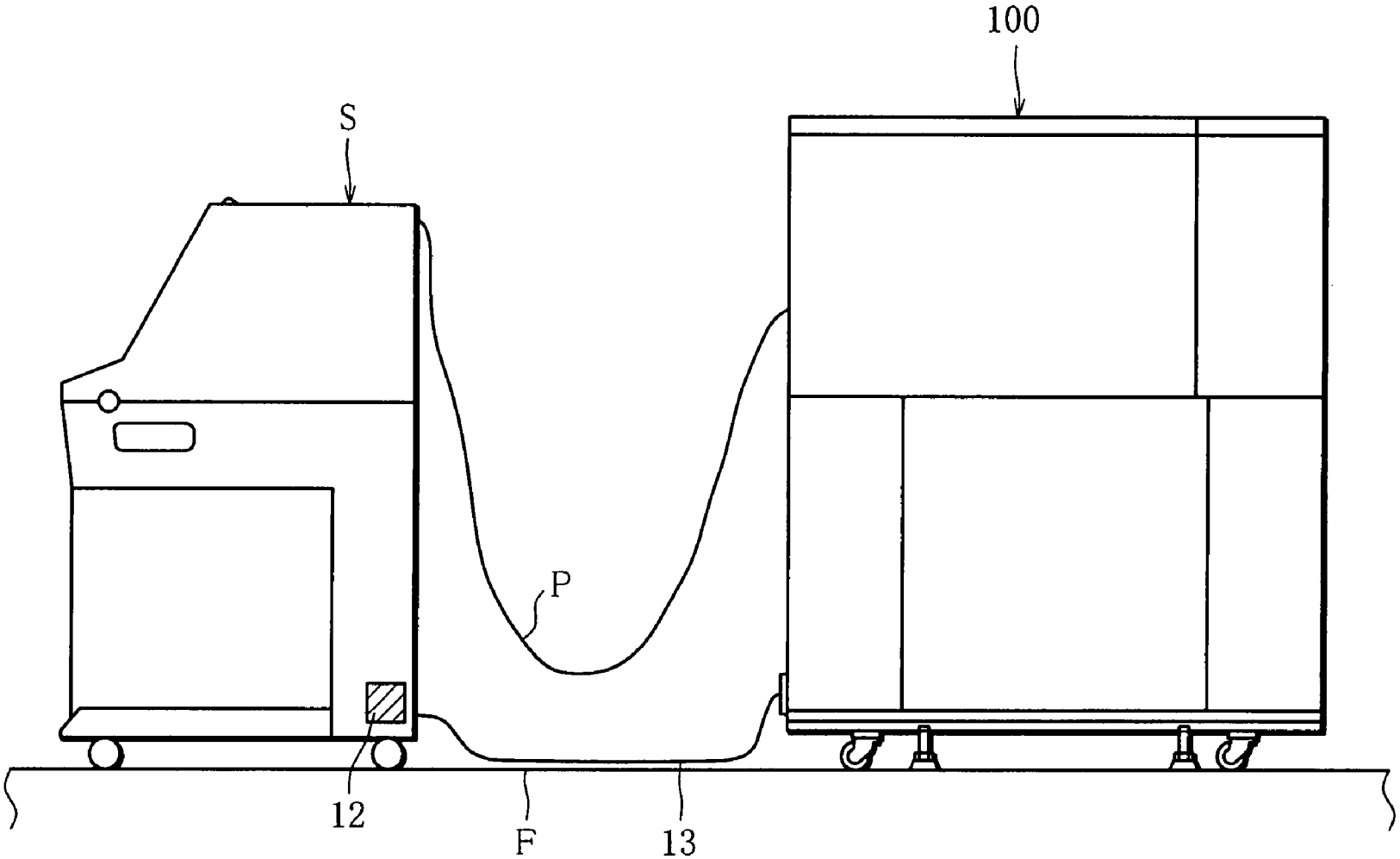
FIG. 5 is a view showing a connection between the folding device and a printing device according to one embodiment of the present invention.

As illustrated in FIG. 5, at the point of time when the autoloading operation is finished, the continuous paper P is in a state being slack in the U shape between the printing device 100 and the folding device S.

In conventional art, the feed rate of the continuous paper P in the folding device S is set to be a little higher than that of the printing device 100 such as a printer. If the folding operation (continuous-paper feeding operation of the folding device S) is started while printing is carried out by the printing device 100 such as a printer, the slack of the continuous paper P becomes small. When the folding operation (continuous-paper feeding operation of the folding device S) is stopped, a slack amount becomes great.

In addition, a state in which the slack amount is great means a state in which distance between a lowest point of the slack of the continuous paper P and a floor surface F shown in FIG. 5 is short. On the other hand, a state in which the slack is small means a state in which the distance between the lowest point of the slack of the continuous paper P and the floor surface F is long. The slack amount is monitored by the buffer sensor. In conventional art, the slack amount is monitored by a single buffer sensor (corresponding to 102*b*, for example). When it is determined that the slack is greater than a prescribed slack, the folding operation is carried out. When it is determined that the slack is smaller than the prescribed slack, the folding operation is suspended and is then performed intermittently.

In the present embodiment, it is possible to perform the folding operation continuously, not intermittently, by using the buffer sensors 102*a*, 102*b* and 102*c*, determining how great the slack is, and setting the folding speed to be variable.

As stated above, the buffer sensors 102*a*, 102*b* and 102*c* are reflected-light type optical sensors. They detect reflected light from a physical object (continuous paper P here), to thereby output the presence of the physical object in the form of ON and OFF signals. Maximum detectable distance of each of the buffer sensors is shorter than distance between the folding device S and the printing device 100, so that the printing device 100 is not mistakenly detected as the continuous paper P if there is no continuous paper P. If a plurality of buffer sensors are used as in the present embodiment, it is possible to determine the slack amount of the continuous paper P more precisely to change the folding speed of the folding device S by comparing outputs of the respective buffer sensors. The folding speed here means the feed rate of the continuous paper P by the tractor unit 1, the swing velocity and timing of the swinger fin 2, and the rotational frequency and timing of the paddle rotary shafts 6*a* and 6*b*.

Figure 18A:
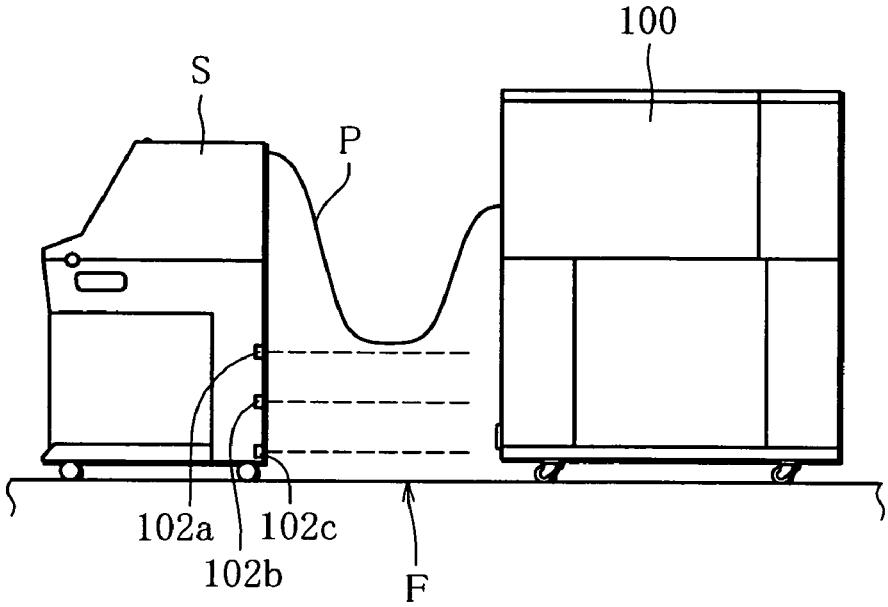
FIG. 18A is a view showing a positional relation between slack of continuous paper and a buffer sensor.
Figure 18B:
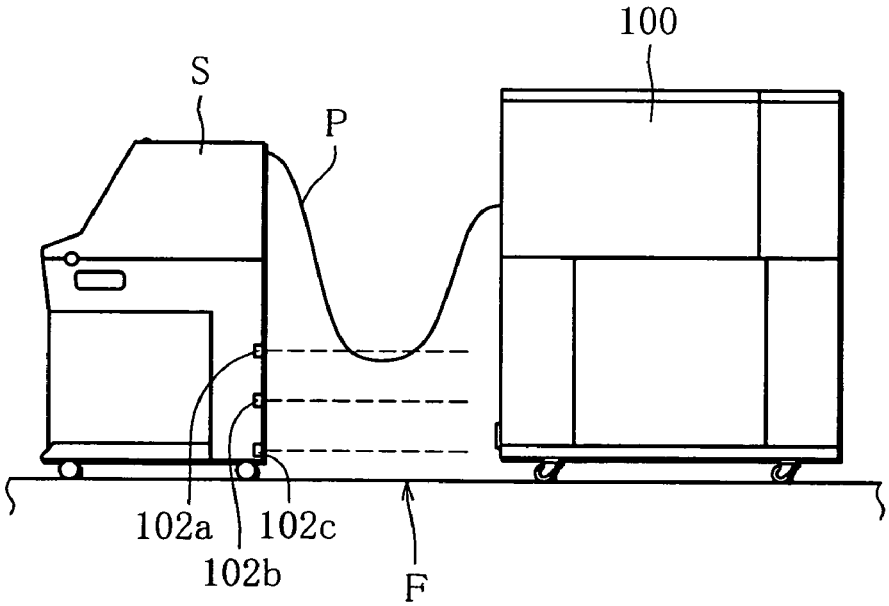
FIG. 18B is a view showing a positional relation between slack of the continuous paper and the buffer sensor.
Figure 18C:
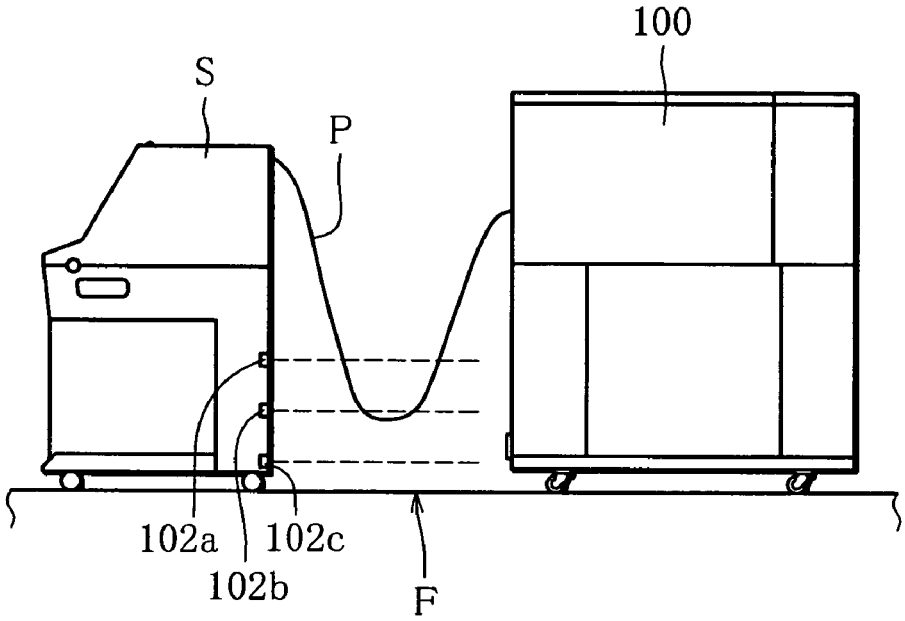
FIG. 18C is a view showing a positional relation between slack of the continuous paper and the buffer sensor.
Figure 18D:
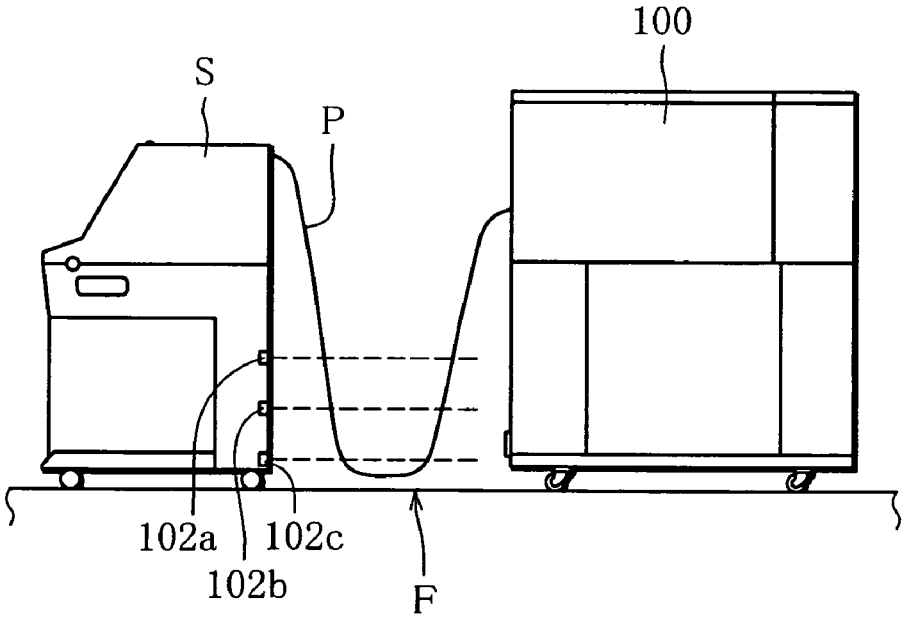
FIG. 18D is a view showing a positional relation between slack of the continuous paper and the buffer sensor.
Figure 18E:
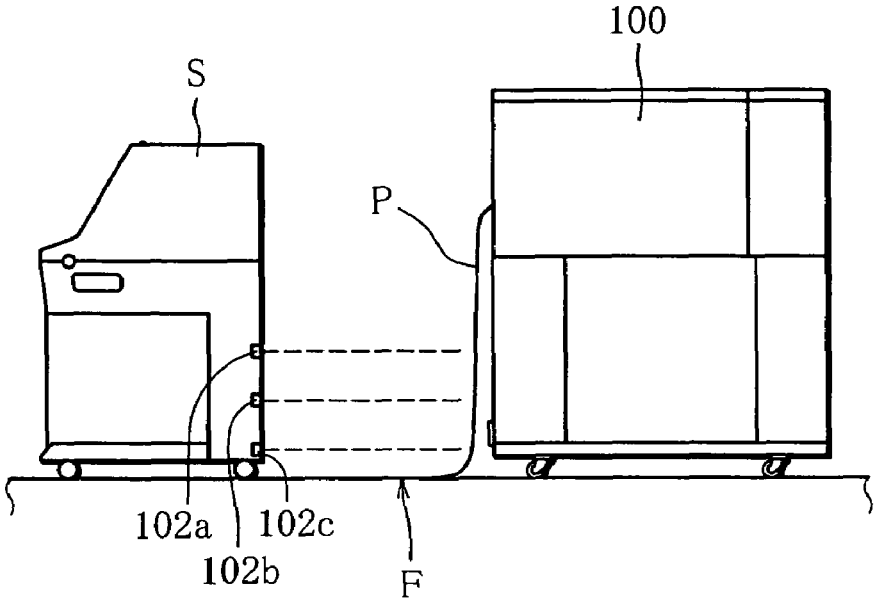
FIG. 18E is a view showing a positional relation between slack of the continuous paper and the buffer sensor.

When none of the buffer sensors 102*a*, 102*b* and 102*c* detects the continuous paper P, slack is extremely small as shown in FIG. 18A or the continuous paper P is not present in between the folding device S and the printing device 100 as shown in FIG. 18E. In either case, the folding device S does not carry out the folding operation and is in a standby state.

If the continuous paper P is detected only by the buffer sensor 102*a*, this is a state in which there is a relatively small slack as illustrated in FIG. 18B. In such a state, the folding device S performs the folding operation at folding speed slower than a standard speed.

If the continuous paper P is detected by the buffer sensors 102*a* and 102*b*, it is determined that the state is as shown in FIG. 18C, the folding device S carries out the folding operation at the standard speed. The standard speed is folding speed in a time period when the feed rate of the tractor unit 1 is substantially equal to printing speed (paper feed rate) of the printing device 100.

When the continuous paper P is detected by all the buffer sensors 102*a*, 102*b* and 102*c*, it is determined that there is a relatively great slack as shown in FIG. 18D, and the folding device S performs the folding operation at folding speed faster than the standard speed.

In the above-stated embodiment, the buffer sensors 102*a*, 102*b* and 102*c* detect only the presence of the continuous paper P and determine the size of the slack from a detection result. It is possible, however, to determine the state of the slack more precisely if a buffer sensor that outputs analog voltage according to distance from the physical object is used.

Figure 18F:
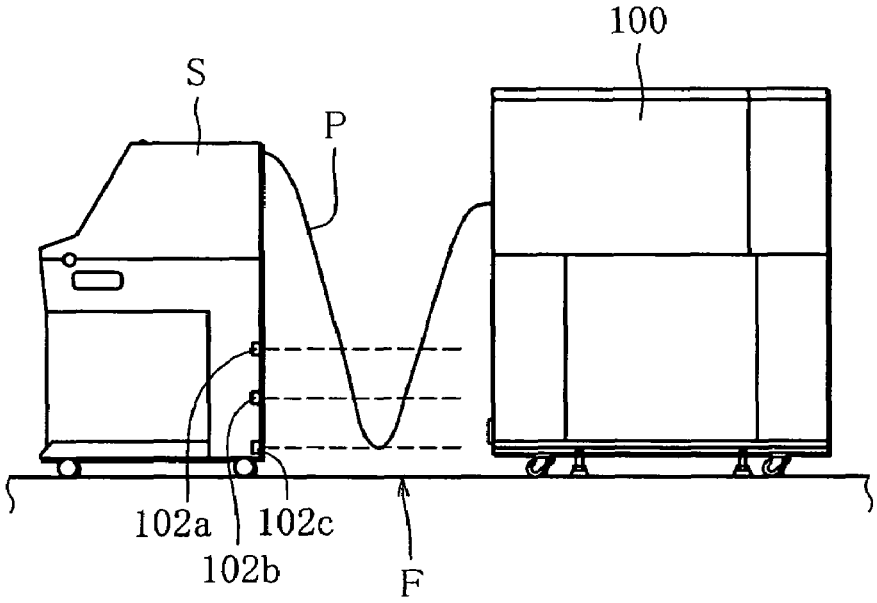
FIG. 18F is a view showing a positional relation between slack of the continuous paper and the buffer sensor.

In this case, distance to the continuous paper P is calculated from analog output of the buffer sensor, and the state of the slack is determined from the detected distance. For example, when FIGS. 18D and 18F are compared to each other, both the drawings show such a slack that all the buffer sensors detect the continuous paper P. In FIG. 18F, however, the detected distance of each of the buffer sensors 102*a*, 102*b* and 102*c* is greater than in FIG. 18D. Therefore, the size of the slack can be determined more precisely, and based thereupon, the folding speed can be made variable more minutely.

By determining the size of the slack from the outputs of the buffer sensors 102*a*, 102*b* and 102*c* and making the folding speed variable as stated above, the folding operation can be continued without stopping the feed of the continuous paper P, which makes it possible to prevent a folding defect from being caused at the start of the folding operation.

As to a method of changing the folding speed, in the present embodiment, activation of the tractor unit 1, the swinger fin 2, and the paddle units 6 and 7 of the folding device S and activation timing are all controlled by a control substrate 14. Accordingly, if clock frequency of the control substrate 14 is changed, operation speed and operation timing of all of them can be changed, which is very preferable because it is not required to perform speed control with respect to the tractor unit 1, the swinger fin 2, and the paddle units 6 and 7 individually, or to add a change to control software.

Figure 6:
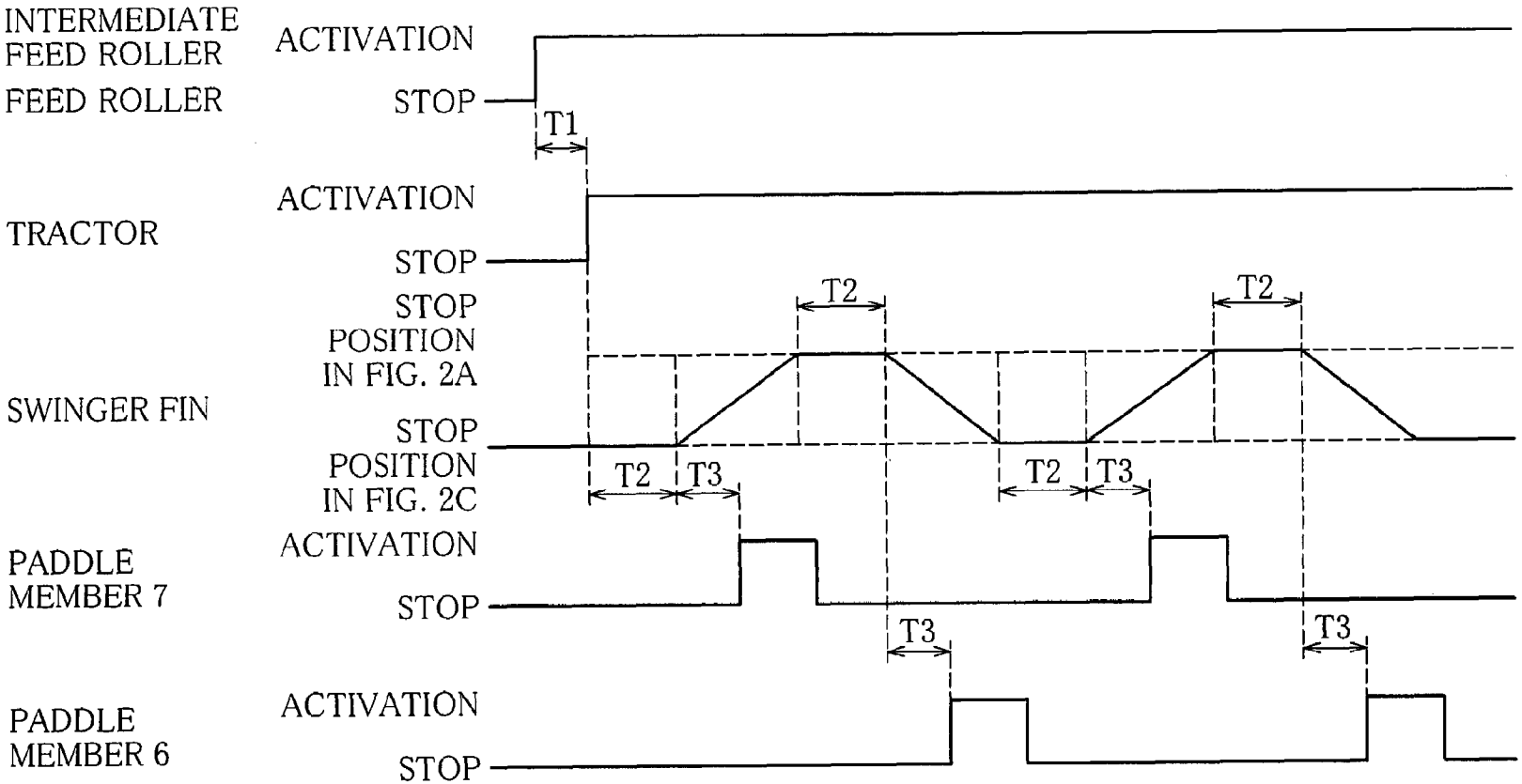
FIG. 6 is a timing chart of the folding device according to one embodiment of the present invention.
Figure 7:
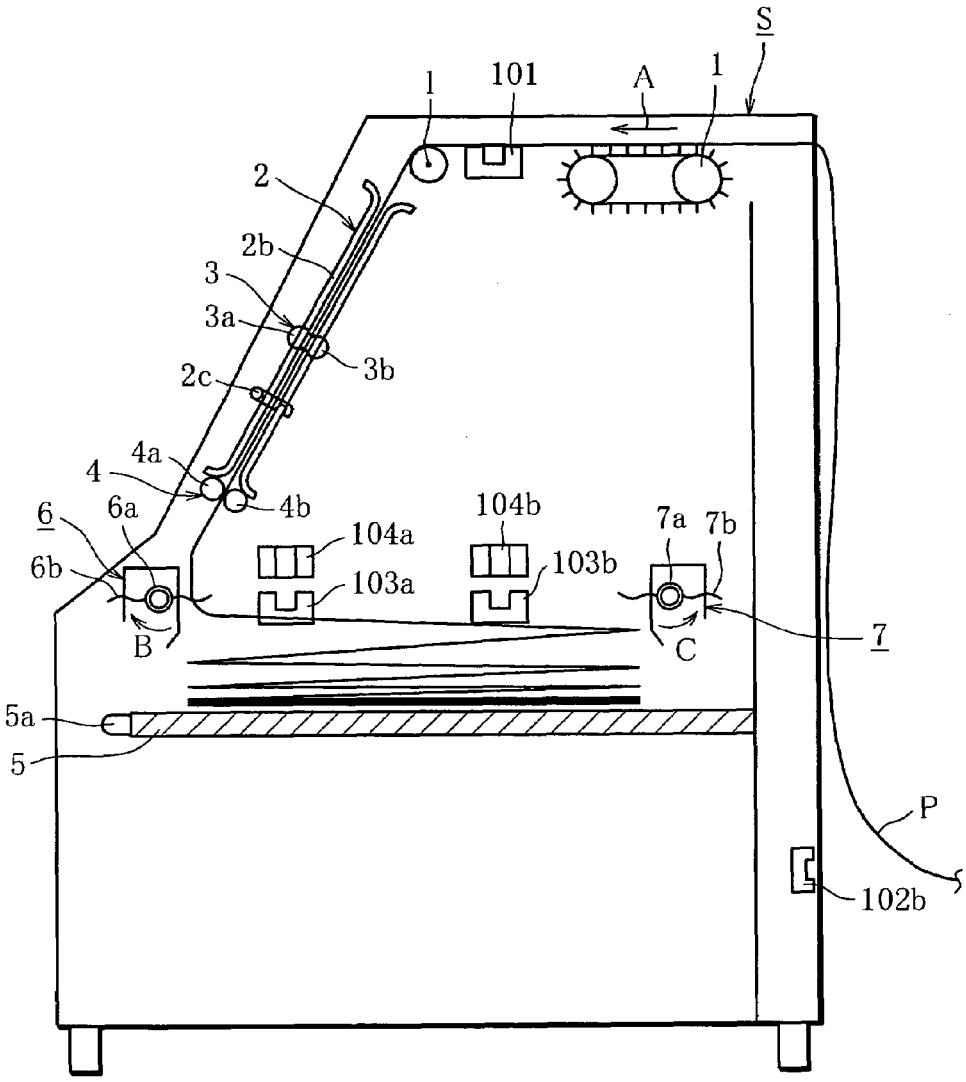
FIG. 7 is a side view of a folding device according to conventional art.

The folding operation will be explained below with reference to a timing chart of FIG. 6.

First, in order to stretch the continuous paper P to rid the slack between the pin tractor 1 and the tip end of the swinger fin 2, the intermediate feed roller pair 3 and the feed roller pair 4 are driven for time T1, or 0.5 seconds here, with the pin tractor 1 remaining at rest. Subsequently, the pin tractor 1 is activated, and the continuous paper P is fed toward the table 5. The swinger fin 2 starts to swing with such timing of time (time T2) that the end of the continuous paper P is located at prescribed distance, or at a distance of 60 mm here, from the tip end of the swinger fin 2. The explanation here refers to a case in which the swinger fin 2 is suspended at a standby position shown in FIG. 2C.

The swinger fin 2 moves to a position shown in FIG. 2A while feeding the continuous paper P onto the table 5, and is then suspended. The swinger fin 2 starts to swing again toward the position shown in FIG. 2C after being suspended for such time (time T2) that the fold line at a rear end of the first page of the continuous paper P is located at prescribed distance, or at a distance of 60 mm here, from the tip end of the swinger fin 2. In this manner, the swinger fin 2 repeatedly swings between the positions shown in FIGS. 2A and 2C in synchronization with the fold lines of the continuous paper P while feeding the continuous paper P onto the table 5 by using the intermediate feed roller pair 3 and the feed roller pair 4.

The stop time T2 of the swinger fin 2 is time that defines amount of protrusion of the end or fold line of the continuous paper P from the tip end of the swinger fin 2, that is, positional relationship between the tip end of the swinger fin 2 and the top surface of the table 5 or the top surface of the continuous paper P folded on the table 5. The stop time T2 is an important value for actualizing a good folding operation. The time T2, namely the stop time T2 of the swinger fin 2 capable of satisfactorily folding the continuous paper P on the table 5 by properly setting the positional relationship, is stored in a nonvolatile memory in the form of a table divided by top-and-bottom lengths after time most suitable for each top-and-bottom length of the continuous paper P is predetermined. A plurality of tables divided by top-and-bottom lengths may be prepared and stored according to thickness or kinds of the paper.

The paddle rotary shaft 7*a* is driven to make one rotation in a direction of arrow C in FIG. 1 after the lapse of prescribed time T3, using start timing of drive of the swinger fin 2 from the stop position shown in FIG. 2C to the position shown in FIG. 2A as a starting point. As a result, the paddle plate 7*b* presses the end or fold line of the continuous paper P and holds down the end or fold line of the continuous paper P from above while preventing the continuous paper P from being pulled by displacement of the swinger fin 2 from a stop position R to a stop position F due to a frictional force of the continuous paper P and the paddle plate 7*b*.

In the same manner, the paddle rotary shaft 6*a* is driven to make one rotation in a direction of arrow B in FIG. 1 after the lapse of the prescribed time T3, using start timing of drive of the swinger fin 2 from the stop position shown in FIG. 2A to the position shown in FIG. 2C as a starting point. Accordingly, the paddle plate 6*b* presses the end or fold line of the continuous paper P and holds down the end or fold line of the continuous paper P from above while preventing the continuous paper P from being pulled by displacement of the swinger fin 2 from the stop position F to the stop position R due to a frictional force of the continuous paper P and the paddle plate 6*b*.

As described above, the paddle rotary shafts 6*a* and 7*a* press down the vicinity of the end or fold line of the continuous paper P laid on the table 5 from above by means of the paddle plates 6*b* and 7*b* while alternately repeating one rotation at a time, whereby the continuous paper P is surely folded on the table 5 along the original fold lines.

The waiting time T3 of the paddle rotary shafts 6*a* and 7*a* is stored in the nonvolatile memory in the form of a table divided by top-and-bottom lengths after time most suitable for each top-and-bottom length of the continuous paper P is predetermined. A plurality of tables divided by top-and-bottom lengths may be prepared and stored according to thickness or kinds of the paper. In the present embodiment, the paddle rotary shafts 6*a* and 7*a* are driven to make only one rotation, but they may be driven to make more than one rotations.

When the height of the top surface of the continuous paper P laid on the table 5 is raised by repeating the folding operation, this reduces the distance between the tip end of the swinger fin 2 and the top surface of the continuous paper P folded on the table 5. As a result, the positional relationship proper for good folding cannot be maintained. Therefore, when one or both of the paper-surface sensors 103*a* and 103*b* detects the top surface of the table 5 or the top surface of the continuous paper P laid on the table 5 during the folding operation, the table 5 is lowered at prescribed distance, for example, 5 mm, to thereby maintain the distance between the tip end of the swinger fin 2 and the top surface of the continuous paper P folded on the table 5 to be proper for good folding.

Detection of oblique travel and meandering travel of the continuous paper P, which is carried out by the travel sensor 101, will be explained below.

In order to monitor sprocket holes of the continuous paper P, the travel sensor 101 is disposed right under the sprocket holes. Since the travel sensor 101 is a reflected-light type optical sensor, the travel sensor 101 outputs periodical ON and OFF signals along with the travel of the continuous paper P correspondingly to pass of the sprocket holes according to the feed rate of the continuous paper P and distance between the sprocket holes. In other words, with timing when the sprocket hole is located immediately above, the travel sensor 101 outputs an ON signal. When being in between the sprocket holes, the travel sensor 101 outputs an OFF signal. When the period of the ON and OFF signals is monitored, and the detection cannot be performed for fixed multiple time, for example, 0.06 seconds, of a time period, for example, 0.03 second period, corresponding to the feed rate of the continuous paper P and the distance between the sprocket holes, it is determined that the continuous paper P has come off the pin tractor 1 and started traveling obliquely or meanderingly. Therefore, the folding operation is stopped.

Consequently, even if the continuous paper P comes off the pin tractor 1, and the oblique or the meandering travel occurs, it is possible to reduce the number of sheets of the continuous paper P damaged by a folding defect. Especially, the continuous paper P with small thickness, for example, 34 kg/ream weight, is expanded and contracted to a great degree by being heated or pressed during a fixing process of the printer, so that the continuous paper P easily comes off the pin tractor 1. The above-mentioned folding device S, however, is capable of detecting a folding defect in an early stage and has a great advantage of reducing the number of damaged sheets of the continuous paper P, attributable to a folding defect.

If the folding device S produces an error such as a folding defect, and the folding operation cannot be continued and is then stopped, the fact that the error occurs in the folding device S may be transmitted to the printer by using the communication means.

Once the printing of the printing device 100 is carried out through to a terminal end of the continuous paper P, and the terminal end is released from the printing device 100, the folding device S stops the folding operation at the point where the terminal end of the continuous paper P passes the buffer sensor 102*b*. In this state, if a release button 11*i* of the operation panel 11 is pressed down, a release operation is implemented. The continuous paper P remaining in the feed path of the folding device S is folded through to the terminal end. Subsequently, the swinger fin 2 is moved to the position shown in FIG. 2C regardless of the top-and-bottom length of the paper to finish the release operation.

By moving the swinger fin 2 to the position shown in FIG. 2C, it becomes possible to check a folding condition of the continuous paper P without opening a cover 10 and moving the swinger fin 2. It is also possible to easily take out the continuous paper P only by opening the cover 10 without lowering the table 5 if the number of laid sheets of the continuous paper P is small, for example, about 50 sheets.

If there are a large number of laid sheets of the continuous paper P, the table-descending button 11*h* of the operation panel 11 is pressed down to lower the table 5 to a position high enough to take out the continuous paper P. Then, a stop button 11*g* of the operation panel 11 is pressed down to stop the descent of the table 5. Subsequently, the handle 5*a* is held, and the table 5 is pulled out. The continuous paper P folded on the table 5 is then removed. If maximum mountable sheets, for example, 3000 sheets, of the continuous paper P are laid on the table 5, the weight of the continuous paper P is considerably heavy. If the table 5 can be pulled out, however, it is possible to relatively easily take out the continuous paper P.

The explanation about the embodiments according to the present invention will be finished here, but the present invention is not limited to the above-described embodiments.

The invention claimed is:

1. A folding device for folding continuous paper, which is previously provided with fold lines at given intervals, along the fold lines in a zigzag pattern, the folding device comprising:

a feeding member of the continuous paper;

a swinger fin that swings using one end thereof as a fulcrum like a pendulum in synchronization with the fold lines while feeding the continuous paper into the inside thereof;

a paddle member for pressing a fold line portion of the continuous paper fed to the swinger fin;

a table to be surmounted by the continuous paper that has been folded; and top-and-bottom length setting means arranged for designating a top-and-bottom length of the continuous paper from a length manually set by an operator of the folding device;

wherein the paddle member includes:

a pair of paddle units in which distance therebetween is variable so as to correspond to the top-and-bottom length of the continuous paper; and a distance-detecting member for detecting the distance between the paddle units;

wherein the folding device further comprises comparison means arranged for comparing the top-and-bottom length designated by the top-and-bottom length setting means with the distance between the paddle units detected by the distance-detecting member; and the folding device displays a warning and/or inhibits the start of a folding operation when the designated top-and-bottom length differs from the detected distance between the paddle units.

2. The folding device according to claim 1, wherein each of the paddle units has a vane member arranged rotatably around a rotary shaft that is substantially parallel to the fold lines; and the vane member is driven and rotated in synchronization with timing of the fold lines to press the fold lines.

3. The folding device according to claim 2, wherein the vane member presses a fold line of the continuous paper with timing when the fold line protrudes from the tip end of the swinger fin by a certain amount.

4. The folding device according to claim 1, wherein, when the folding device completes the folding operation, the swinger fin is swung and fixed to the opposite side to a retrieving direction of the continuous paper that has been folded on the table.

5. The folding device according to claim 1, wherein the continuous paper has a basic weight of 64 g/m$^2$ or less.

6. The folding device according to claim 1, wherein the continuous paper is label paper or tack paper.

7. A printing system at least comprising an image-forming device capable of forming an image on continuous paper and the folding device according to claim 1.

8. The printing system according to claim 7, wherein the image-forming device includes a heat-fixing device.

9. The printing system according to claim 8, wherein the heat-fixing device operates by a flash-fixing method.

10. The folding device according to claim 1, wherein the folding device is capable of changing operation thereof so as to permit the folding operation based on the designated top-and-bottom length regardless of a difference between the designated top-and-bottom length and the detected distance between the paddle units.

11. A folding device for folding continuous paper, which is previously provided with fold lines at given intervals, along the fold lines in a zigzag pattern, the folding device comprising:

a feeding member of the continuous paper;

a swinger fin that swings using one end thereof as a fulcrum like a pendulum in synchronization with the fold lines while feeding the continuous paper into the inside thereof;

a paddle member for pressing a fold line portion of the continuous paper fed to the swinger fin;

a table to be surmounted by the continuous paper that has been folded; and top-and-bottom length setting means arranged for designating a top-and-bottom length of the continuous paper from a length manually set by an operator of the folding device;

wherein the paddle member includes:

a pair of paddle units in which distance therebetween is variable so as to correspond to the top-and-bottom length of the continuous paper; and a distance-detecting member for detecting the distance between the paddle units;

wherein the folding device further comprises:

communication means arranged for communicating with a printing device for printing on the continuous paper; and comparison means arranged for comparing a communicated top-and-bottom length obtained from the printing device by using the communication means with the designated top-and-bottom length and/or the detected distance between the paddle units; and the folding device displays a warning and/or inhibits the start of a folding operation when the communicated top-and-bottom length differs from the designated top-and-bottom length and/or the detected distance between the paddle units.

12. The folding device according to claim 11, wherein the folding device is capable of changing operation thereof so as to permit the folding operation based on the communicated top-and-bottom length regardless of whether or not the communicated top-and-bottom length differs from the designated top-and-bottom length and/or the detected distance between the paddle units.

13. A printing system at least comprising an image-forming device capable of forming an image on continuous paper and the folding device according to claim 11.

* * * * *